US007162965B2

(12) United States Patent
Terao et al.

(10) Patent No.: US 7,162,965 B2
(45) Date of Patent: Jan. 16, 2007

(54) SEWING MACHINE

(75) Inventors: Akira Terao, Ama-gun (JP); Yoko Nakagawa, Nagoya (JP); Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/284,851

(22) Filed: Nov. 23, 2005

(65) Prior Publication Data

US 2006/0107883 A1 May 25, 2006

(30) Foreign Application Priority Data

Nov. 24, 2004 (JP) ..... 2004-339074

(51) Int. Cl.
*D05B 29/02* (2006.01)

(52) U.S. Cl. ..... 112/238

(58) Field of Classification Search ..... 112/271, 112/273, 277, 278, 235, 237, 238, 239, 254, 112/302

See application file for complete search history.

(56) References Cited

U.S. PATENT DOCUMENTS 3,602,169 A * 8/1971 Miller et al. ..... 112/238
3,960,098 A * 6/1976 Papajewski et al. ..... 112/286
4,364,319 A * 12/1982 Niehaus et al. ..... 112/238
5,080,031 A * 1/1992 Suzuki et al. ..... 112/286
6,968,794 B1 * 11/2005 Price et al. ..... 112/475.01

FOREIGN PATENT DOCUMENTS

| | | |
|---|---|---|
| JP | U-02-130574 | 10/1990 |
| JP | A-06-079079 | 3/1994 |
| JP | A-06-134165 | 5/1994 |
| JP | Y2-02-588723 | 11/1998 |

* cited by examiner

*Primary Examiner*—Danny Worrell
(74) *Attorney, Agent, or Firm*—Oliff & Berridge, PLC

(57) ABSTRACT

The sewing machine includes a presser foot that is lowered to press a workpiece cloth; a presser foot lifting lever operating the presser foot; a thread tension mechanism including a thread tension regulator capable of adjusting the thread tension of a needle thread and opening the thread tension regulator based on the lifting operation of the presser foot lifting lever; and a thread guide groove guiding the needle thread at least to the thread tension mechanism, upon carrying out the thread hooking work. The sewing machine further includes a detector detecting a lifting operation of the presser foot lifting lever; a covering member which is movable between a closed position where the covering member covers at least a part of the thread guide groove and an opened position where the covering member opens the thread guide groove. The covering member is moved to the closed position when the presser foot is in a lowered state. An actuator moves the covering member at least from the closed position to the opened position. A controller controls the actuator so that the covering member is moved to the opened position when the detector detects the lifting operation of the presser foot lifting lever.

12 Claims, 18 Drawing Sheets

SEWING MACHINE

CROSS-REFERENCE TO RELATED APPLICATIONS

This application is based upon and claims the benefit of priority from the prior Japanese Patent Application No. 2004-339074, filed on Nov. 24, 2004 the entire contents of which are incorporated herein by reference.

BACKGROUND OF THE INVENTION

1. Field of the Invention

The present invention relates to a sewing machine in which a needle thread drawn from a thread supply is hooked along a thread guide groove, and more particularly to such a sewing machine provided with means for preventing errors in hooking the thread to a thread tension regulator.

2. Description of the Related Art

A sewing machine is provided with a thread tension mechanism that opens and closes a thread tension regulator constructed by a pair of thread tension discs. The thread tension mechanism is linked to a presser foot lifting lever. When a user lifts the presser foot lifting lever, the thread tension regulator is opened. In this state, the user is able to hook the needle thread between the thread tension discs. As opposed to this, the thread tension regulator is closed when the user lowers the presser foot lifting lever. In this state, the needle thread cannot be hooked between the thread tension discs. Therefore, the user is unexceptionally required to lift the presser foot lifting lever upon hooking the needle thread on the thread tension regulator.

For example, Japanese Registered Utility Model No. 2588723 (pages 2 to 3, FIGS. 2 and 3) discloses a thread-hook error-prevention device which opens and closes the thread tension regulator in conjunction with a vertical movement of the presser foot. At the same time, a guide plate is moved to a location where a thread take-up thread-hook opening is opened or closed. That is, when the user lifts the presser foot lifting lever, the thread tension regulator is opened, and the guide plate opens the thread take-up thread-hook opening. In this state, the user is able to hook the needle thread on the thread tension regulator and the thread take-up. As opposed to this, when the user lowers the presser foot lifting lever, the thread tension regulator is closed, and the guide plate covers the thread take-up thread-hooking opening. In this state, the user is not able to hook the thread on the thread tension regulator and the thread take-up.

In such construction, the presser foot lifting lever is linked to the thread tension mechanism and the guide plate via a cam, a link member, a mounting member, and the like. The guide plate is urged in the closing direction of the thread take-up thread-opening. Therefore, when lifting the presser foot lifting lever to hook the thread, the user necessitates an operational force to move the link member and the mounting member against the spring force of a helical extension spring as well as the operational force to lift the presser foot. Consequently, a large operational force is imposed upon the user, providing very poor operability.

Furthermore, a plurality of members including a cam, a link member and a mounting member need to be provided in order that the guide plate may be opened and closed. This necessity results in problems such as an increase in the number of parts.

SUMMARY OF THE INVENTION

Therefore, an object of the present disclosure is to provide a sewing machine with improved operability requiring less operational force in operating the presser foot lifting lever as well as requiring fewer parts in moving the covering member between the opened and closed state.

The sewing machine of the present disclosure includes a presser foot that presses a workpiece cloth when in a lowered state; a presser foot lifting lever operated to lift the presser foot; a thread tension mechanism provided with a thread tension regulator capable of adjusting the thread tension of a needle thread, the thread tension regulator being opened by a lifting operation of the presser foot lifting lever and a thread guide groove that guides the needle thread drawn from a thread supply source at least to the thread tension mechanism, upon thread hooking. The sewing machine of the present disclosure further includes a detector to detect the lifting operation of the presser foot lifting lever, a covering member which is movable between a closed position where the covering member covers at least a part of the thread guide groove and an opened position where the covering member opens the thread guide groove, the covering member being moved to the closed position when the presser foot is in a lowered state, an actuator that moves the covering member at least from the closed position to the opened position, and a controller that controls the actuator so that the covering member is moved to the opened position when the detector detects the lifting operation of the presser foot lifting lever.

According to such construction, when the lifting operation of the presser foot lifting lever is detected by the detector, the controller controls the actuator so that the covering member is moved to the opened position. Consequently, the thread guide groove is switched from the closed position to the opened position, thereby uncovering the thread guide groove, and the user can at least hook the thread to the thread tension regulator. Since the covering member is moved to the opened position by the drive force of the actuator, the operational force required for lifting the presser foot lifting lever is reduced, thereby improving the operability.

Furthermore, since the movement of the covering member to the opened position is performed in conjunction with the drive of the actuator, multitude of members such as the cam, the link member and the mounting member need not be linked to the presser foot lifting lever. Therefore, fewer parts are used in the opening-and-closing mechanism that moves the covering member to the opened position; thereby enabling a cost reduction of the opening-and-closing mechanism.

In another aspect, the present disclosure provides a sewing machine including a stitch former that forms an embroidery stitch on a workpiece cloth retained by an embroidery frame; a frame driver that moves the embroidery frame; and a sewing controller that controls the frame driver and the stitch former so that an embroidery pattern is formed based on embroidery data. The sewing machine of the present disclosure further includes a thread guide groove that guides the needle thread, drawn from a thread supply, to a predetermined thread path upon hooking the thread; a covering member which is movable between a closing position where the covering member covers at least a part of the thread guide groove and an opening position where the covering member uncovers the thread guide groove, and which is moved to the closing position when in stitch forming state; an actuator that moves the covering member at least from the closing position to the opening position; and a controller that drive controls the actuator such that the covering member is moved to the opening position upon completion of embroidery sewing by the sewing controller.

According to such construction, upon completion of embroidery sewing, the actuator is driven so that the covering member is moved to the opening position. That is, the movement of the covering member to the opening position is not performed in conjunction with the lifting operation of the presser foot lifting lever, but is performed automatically by the drive force of the actuator, upon completion of embroidery sewing. Therefore, the covering member can be moved to the opening position without having to take the steps of operating the presser foot lifting lever, and the thread exchange to be carried out upon sewing the subsequent embroidery patterns become easier, thereby improving the operability.

BRIEF DESCRIPTION OF THE DRAWINGS

Other objects, features and advantages of the present invention will become clear upon reviewing the following description with reference to the accompanying drawings, in which.

DETAILED DESCRIPTION OF THE INVENTION

One embodiment according to the present invention will be described hereinafter with reference to the drawings.

Figure 1:
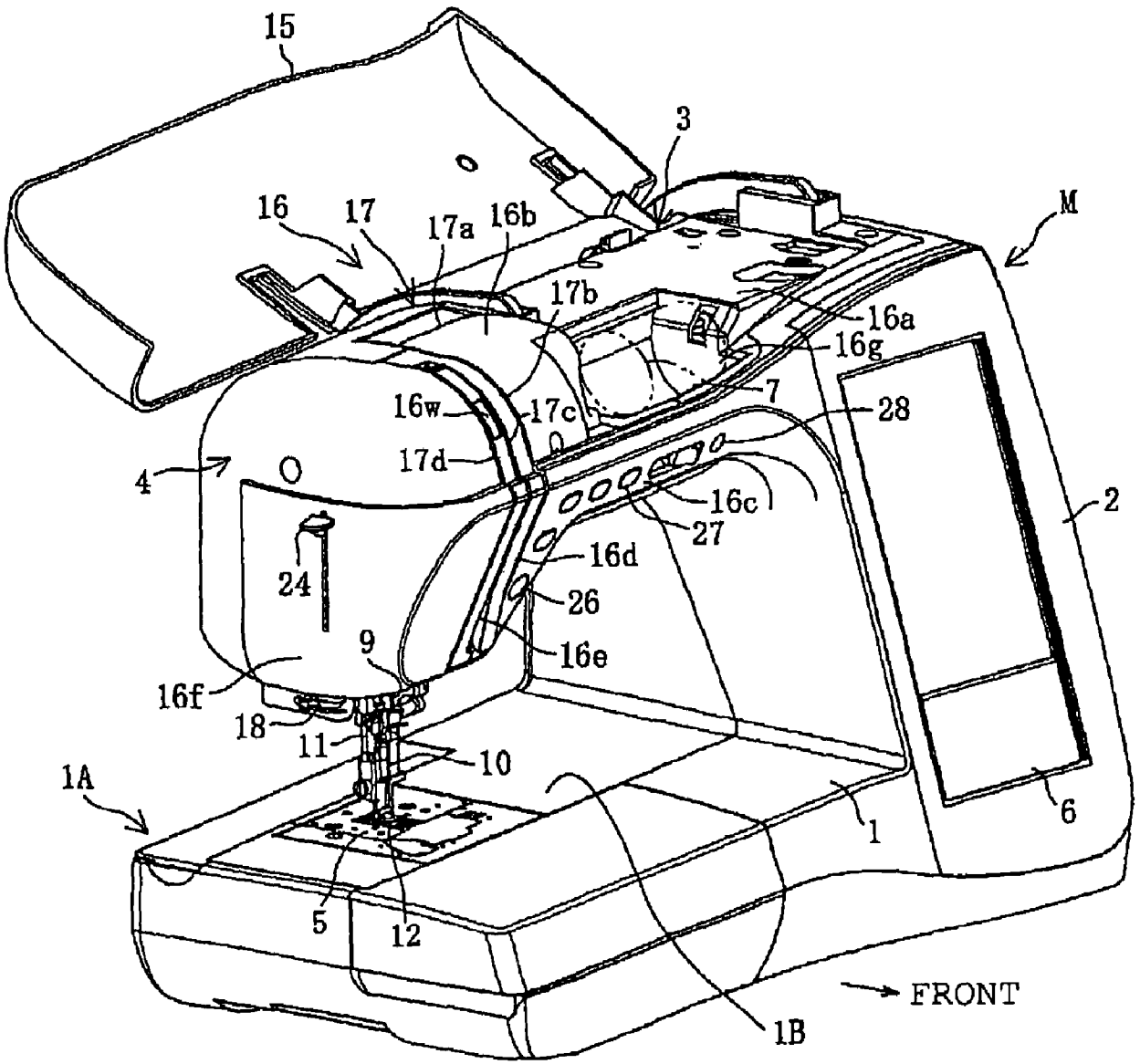
FIG. 1 shows a perspective view of an electronic sewing machine according to an aspect of the present disclosure.

As shown in FIG. 1, the electronic sewing machine M includes a bed 1, a pillar 2 standing on the right end of the bed 1, an arm 3 extending leftward so as to oppose the bed 1, and a head 4 provided on the left end of the arm 3. A needle plate 5 is provided on the bed 1. A thread trimming mechanism 85 (refer to FIG. 13), a rotary hook (not shown), and the like are provided below the needle plate 5. To the rotary hook, a bobbin wound with a lower thread is detachably attached to the rotary hook. A large type vertical liquid crystal display 6 is provided on the front surface of the pillar 2. An arm cover 15 covering the arm 3 is provided on the arm 3. This arm cover 15 is rotatably supported by a rotational shaft laterally provided on the upper-rear end of the arm 3.

Figure 2:
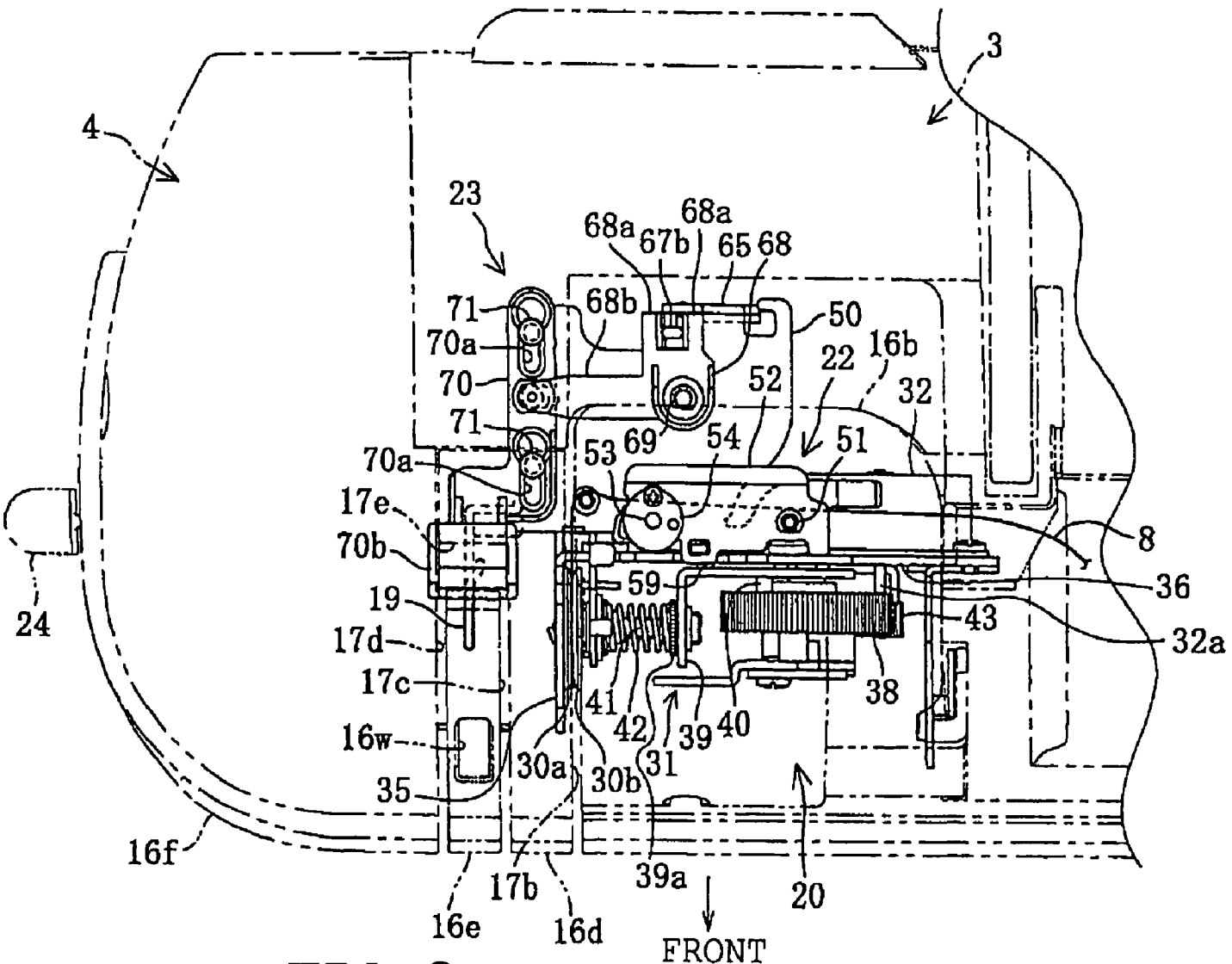
FIG. 2 shows a partial flat view indicating an inner construction of an arm in case the covering member is in a closing position.
Figure 3:
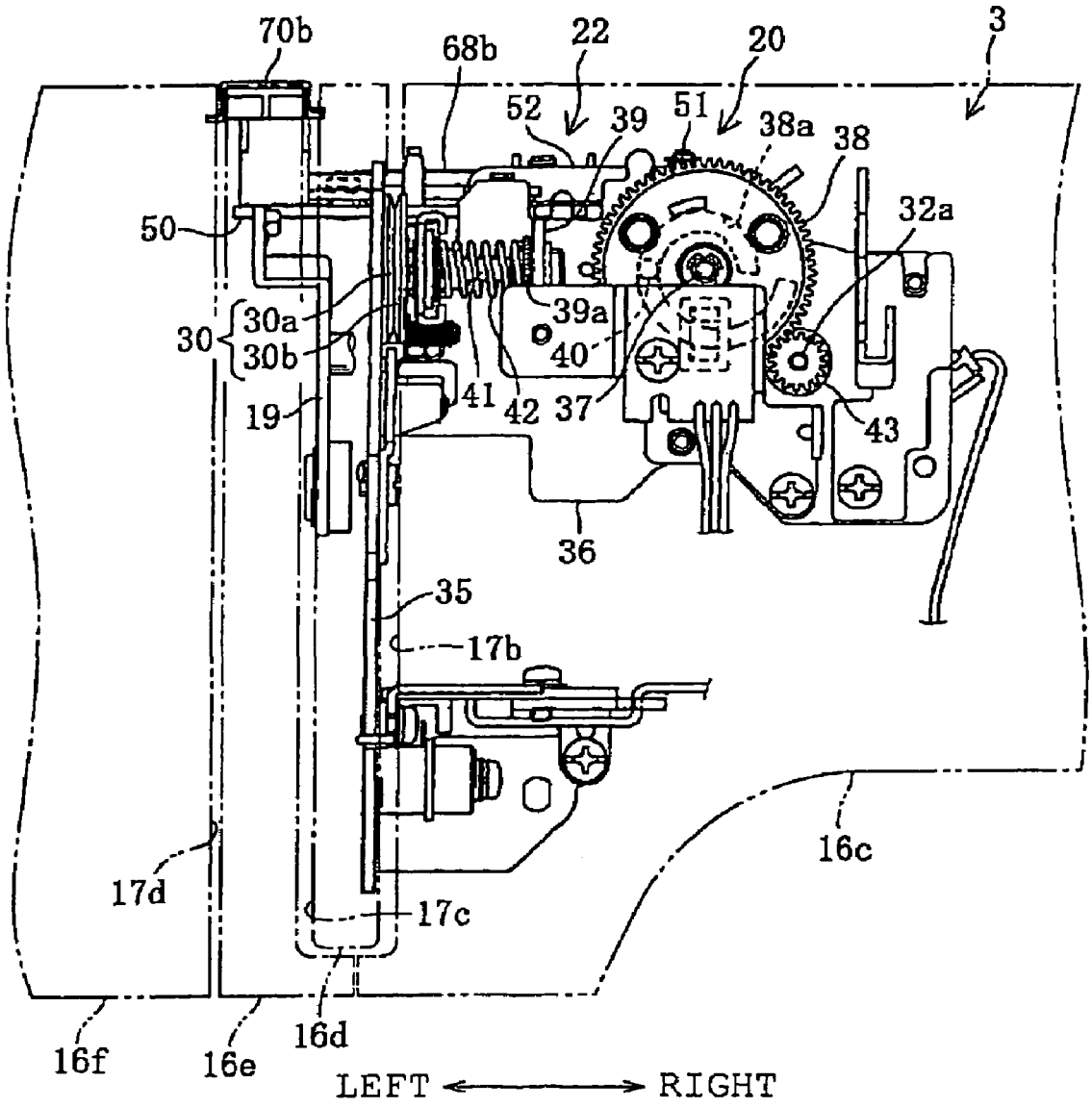
FIG. 3 shows a partial front view indicating an inner construction of an arm in case the covering member is in a closing position.

A sewing machine cover 16 is provided on the arm 3. The sewing machine cover 16, as shown in FIGS. 1 and 2, has a cover divided into plurality of portions such as a first cover 16*a* and a second cover 16*b*. A thread spool accommodation 16*g* is formed on the first cover 16*a*. A spool pin (not shown) is arranged on the thread spool accommodation 16*g*. A thread spool 7 which serves as a thread supply source is attached to the spool pin in the lateral direction.

A front cover 16*c* covers most of the area in the lower front portion of the arm 3. On the front cover 16*c*, a start-stop switch 26 that instructs the start and the end of a sewing process and a thread hook preparation switch 27 (corresponds to preparation instructor) to be operated upon performing the thread hook operation are provided.

A first cover member 16*d* and a second cover member 16*e* are each in an elongated form having a predetermined width. The second cover member 16*e* covers the front and the upper portion of the thread take-up 19 (refer to FIG. 2). Also, a transparent window 16*w* is provided on the upper portion of the second cover member 16*e*. Therefore, the user can easily confirm whether the needle thread has been hooked on the thread take-up 19 or not, through the transparent window 16*w*. A large surface plate 16*f* covers most of the area of the head 4.

A thread guide groove (thread introductory portion) 17 is formed on the sewing machine cover 16 for hooking a thread on the needle thread 8. The thread guide groove 17 comprises a first thread guide groove 17*a*, a second thread guide groove 17*b*, a third thread guide groove 17*c*, and a fourth thread guide groove 17*d*. The first thread guide groove 17*a* is formed in the lateral direction so as to be sandwiched between the first cover 16*a* and the second cover 16*b*. The second thread guide groove 17*b* is formed so as to be oriented downward in between the second cover 16*b* and the first cover member 16*d* in the left thereof, so as to be connected to the first thread guide groove 17*a*.

The third thread guide groove 17*c* is formed so as to be oriented upward between the first cover member 16*d* and the second cover member 16*e* to the left thereof, so as to be connected to the first thread guide groove 17*b*. The fourth thread guide groove 17*d* is formed so as to be oriented downward in between the second cover member 16*e* and the surface plate 16*f* to the left thereof so as to be connected to the third thread guide groove 17*c*.

In the head 4 are provided a needle bar 9, a presser bar 11, a thread take-up 19, a thread tension mechanism 20 (refer to FIG. 2), a thread take-up spring 21 (refer to FIG. 4), an auxiliary thread tension mechanism 22 (refer to FIG. 2), an open-close drive mechanism 23 (refer to FIG. 2), a threading mechanism 201 (refer to FIGS. 17 and 18), and the presser lifting mechanism 25 (refer to FIG. 10), and the like, as shown in FIGS. 1 to 5.

The needle bar 9 is supported vertically reciprocably by a needle bar base 202 (refer to FIG. 17) provided on the sewing machine frame. A needle bar thread guide 213 (refer to FIG. 17) is provided on the lower end of the needle bar 9, in addition to a sewing needle 10 attached thereto. This needle bar 9 is vertically driven by a sewing machine drive mechanism (not shown) having a sewing machine motor 110 (refer to FIG. 13). The needle bar 9 mounted with the sewing needle 10, the rotary hook, and the like constitute a stitch former.

The presser bar 11 is arranged behind the needle bar 9, and is liftably supported by the sewing machine frame. A presser foot 12 (refer to FIG. 1) is attached to a lower end of the presser bar 11.

Next, the thread tension mechanism 20 (refer to FIG. 2) will be described. The thread tension mechanism 20 is provided with a thread tension regulator 30, a tension adjusting mechanism 31, and a thread tension motor 32 corresponding to an actuator.

The thread tension regulator 30 comprises a pair of thread tension discs 30*a* and 30*b* (refer to FIGS. 2 and 3) arranged behind the second thread guide groove 17*b*. A thread tension shaft 41 which will be described in detail later is passed through a thread tension disc 30*b* arranged to be movable in the lateral direction. The thread tension regulator 30 applies tension to the needle thread 8 by holding the needle thread 8 between the thread tension discs 30*a* and 30*b*.

The tension adjusting mechanism 31 is provided with a guide frame 35, a mounting plate 36 (refer to FIG. 3), a tension adjustment gear 38, and a compression coil spring 42. The guide frame 35 is disposed so as to extend in the longitudinal direction with respect to the electronic sewing machine M and is in the form of a flat surface which is elongated in the vertical direction with respect to the electronic sewing machine M. The mounting plate 36 is arranged perpendicularly with respect to the guide frame 35 and is in a form of a flat surface elongated in the lateral direction of the electronic sewing machine M. One end (left side) of the mounting plate 36 is integrally fixed to the upper portion of the guide frame 35. Also, a shaft 37 protruding toward the front side (front face) of the sewing machine M is fixed to the sewing machine M. A circular tension adjusting gear 38 is rotatably supported by the shaft 37. A spiral cam 38*a* (refer to FIG. 3) is recessed into the rear side (back side) of the tension adjustment gear 38.

A thread tension plate 39 (refer to FIG. 2) is in an L-shape in flat view. An actuating pin 59 (refer to FIG. 5) protruding to the back side of the electronic sewing machine M is fixed to one end (left side) of the thread tension plate 39. The actuating pin 59 is inserted into a laterally elongated hole (not shown) formed on the mounting plate 36. Furthermore, an engagement pin 40 protruding to the front side (front face) of the electronic sewing machine M is fixed to the other end (right side) of the thread tension plate 39. The engagement pin 40 is engaged to the spiral cam 38*a* provided on the tension adjustment gear 38.

A cylindrical spring-receiving member 39*a* is fixed to a bent surface provided in the left side of the thread tension plate 39. The right end of the thread tension shaft 41 fixed to the guide frame 35 is fitted into the spring-receiving member 39*a* from the left side. On the thread tension shaft 41, the compression coil spring 42 is interposed between the thread tension disc 30*b* and the spring-receiving member 39*a*. The compression coil spring 42 presses the movable thread tension disc 30*b* against the fixed thread tension disc 30*a*.

The thread tension motor 32 is fixed to the rear side (back side) of the mounting plate 36. A drive shaft 32*a* of the thread tension motor 32 penetrates the mounting plate 36, and a drive gear 43 is fixed on the end point of the drive shaft 32*a*. The tension adjustment gear 38 is in mesh engagement with the drive gear 43.

When the thread tension motor 32 is driven in the sewing machine M thus constructed, the tension adjustment gear 38 is rotated via the drive gear 43. When the tension adjustment gear 38 is rotated, the engagement pin 40 is brought into engagement to the spiral cam 38*a*, generating the lateral movement of the thread tension plate 39. Consequently, the spring force of the compression coil spring 42 pressing the thread tension disc 30*b* toward the thread tension disc 30*a* is variably adjusted. Thus, the thread tension mechanism 20 adjusts the thread tension applied to the needle thread by the thread tension discs 30*a* and 30*b*.

Figure 6:
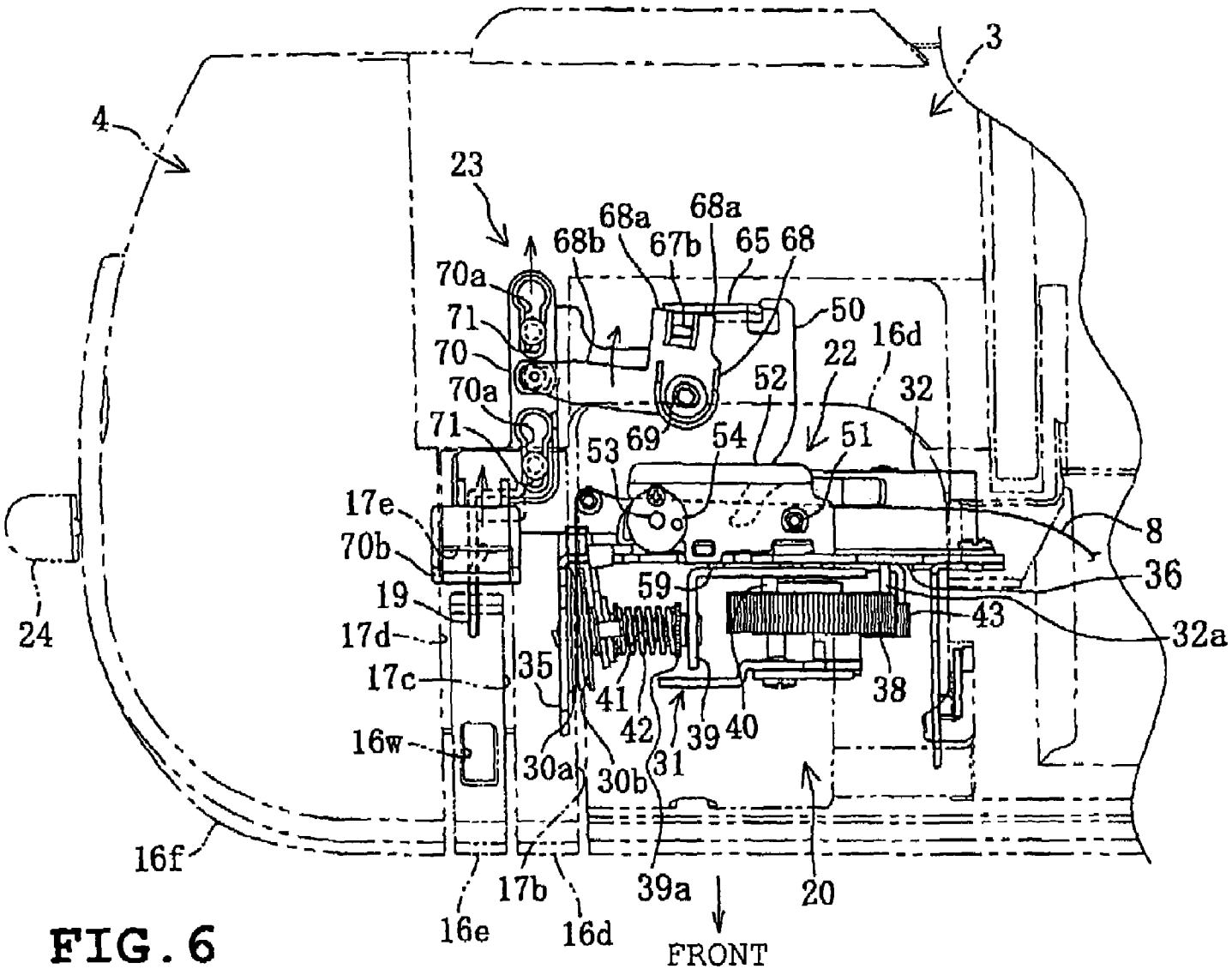
FIG. 6 shows a partial flat view indicating an inner construction of an arm in case the covering member is in an opening position.

The spring force of the compression spring 42 reduces in proportion to the amount of rightward movement of the thread tension plate 39. Hence, the pressure between the thread tension discs 30*a* and 30*b* is reduced, and the tension of the needle thread 8 is gradually reduced as well. Eventually, after reaching "zero" thread tension, the thread tension discs 30*a* and 30*b* are separated from each other into an "opened" state (refer to FIG. 6). As opposed to this, the compression coil spring 42 increases in proportion to the amount of leftward movement of the thread tension plate 39. The pressure between the thread tension discs 30*a* and 30*b* is increased, and the tension of the needle thread 8 is gradually increased as well (refer to FIG. 2).

Next, the thread take-up spring 21 (refer to FIG. 4) will be described. The thread take-up spring 21 is mounted below the thread tension mechanism 20 and in the lower end of the of the guide frame 35 so as to be able to elastically urge the needle thread 8. When the user hooks the needle thread 8 between the thread tension discs 30*a* and 30*b*, as well as introducing the needle thread 8 down into the second thread guide groove 17*b*, and back up the third thread guide groove 17*c*, the needle thread 8 becomes hooked onto the thread take-up spring 21 from below.

Next, the auxiliary thread tension mechanism (pretension mechanism) 22 will hereinafter be described (refer to FIG. 2). The auxiliary thread tension mechanism 22 is provided with a support plate 50, a spring-receiving pin 51 and a pretension plate 52.

The upper surface of the support plate 50 is formed as a substantially horizontal surface. The front end of the support plate 50 is bent downward, forming a vertical wall 50*b* (refer to FIG. 4). The upper end of the vertical wall 50*b* is fixed to an upper end of the mounting plate 36. The rear end of the support plate 50 is bent downward forming a support 50*a* (refer to FIG. 4). The spring-receiving pin 51 (refer to FIG. 2) stands upright on a right end of the upper surface of the support plate 50. The pretension plate 52 has a right end formed as a thin plate arranged on the upper surface of the support plate 50. The right end of the pretension plate 52 is fitted with the spring-receiving pin 51. A compression coil spring (not shown) is interposed between the pretension plate 52 and a stopping member fixed on the upper end of the spring-receiving pin 51. The right end of the pretension plate 52 is normally urged toward the support plate 50 by a weak spring force of this compression coil spring.

The upper end of a tension releasing pin 53 (refer to FIGS. 2 and 4) in a pillar form penetrates the left end of the support plate 50 and the pretension plate 52. A circular tension adjustment plate 54 is fixed to the upper end of the tension releasing pin 53. The portion near the lower end of the tension releasing pin 53 is vertically movably supported by the lower end of the vertical wall 50*b* of the support plate 50 (refer to FIG. 4).

A spring-receiving member 55 (refer to FIGS. 4 and 5) is fixed near the lower end of the tension releasing pin 53. A compression coil spring 56 is interposed between the spring-receiving member 55 of the tension releasing pin 53 and the support plate 50. The compression coil spring 56 downwardly urges the tension releasing pin 53 via the spring-receiving member 55. Hence, the left end of the pretension plate 52 is urged toward the support plate 50 via the tension adjustment plate 54 fixed to the upper end of the tension releasing pin 53. In the back side of the vertical wall 50*b* of the support plate 50, a pivot pin 58 (refer to FIG. 5) is protruded rearward. A base end of a swinging member 57 substantially L-shaped in rear view is rotatably supported on the pivot pin 58. That is, the sliding member 57 is rotatably arranged with respect to the vertical wall 50*b*.

Figure 5:
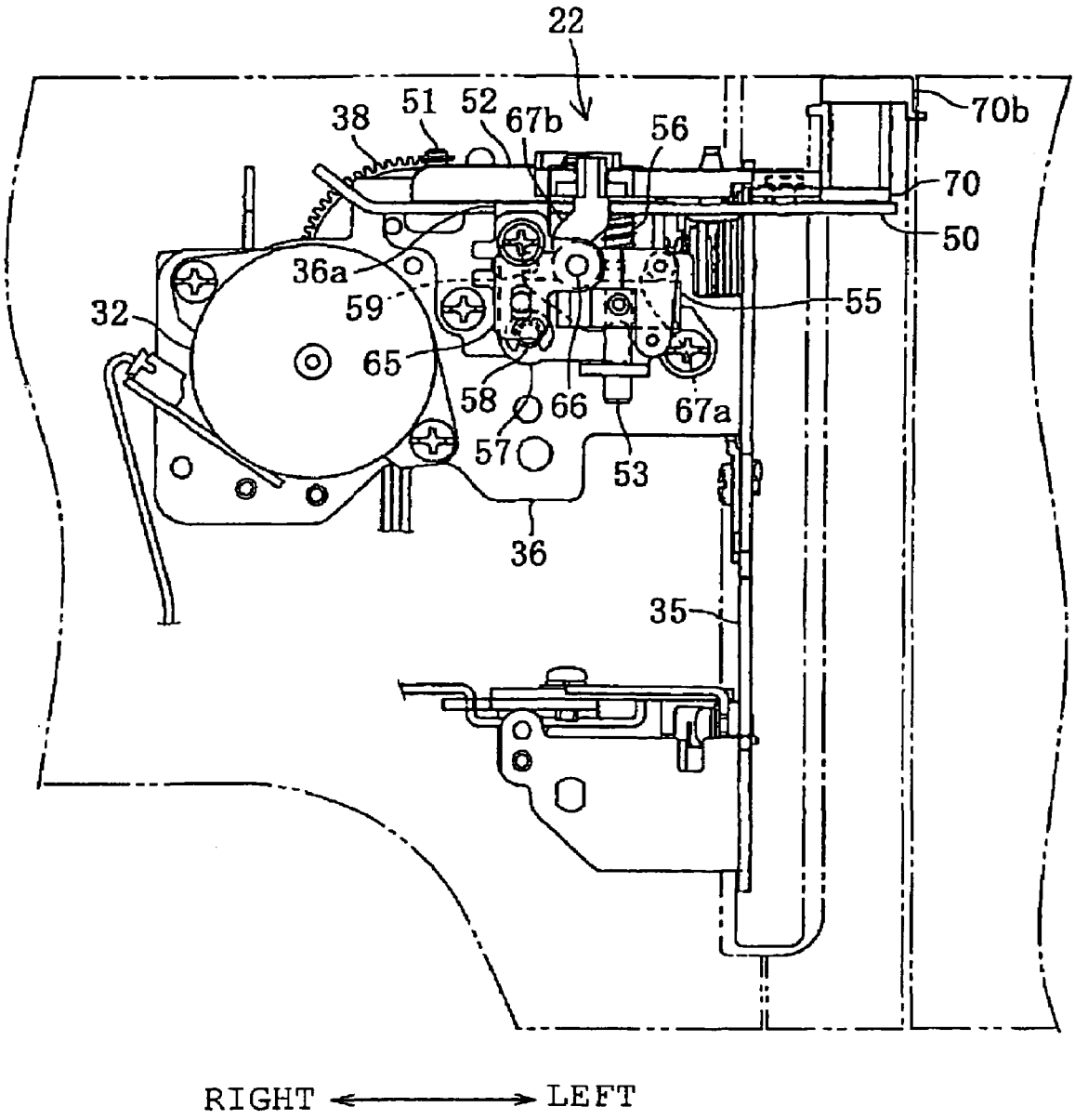
FIG. 5 shows a partial rear elevation view indicating an inner construction of an arm in case the covering member is in a closing position.

As described above, the actuating pin 59 of the thread tension plate 39 penetrates the mounting plate 36, and extends to the back side (rear side). The actuating pin 59 as shown in FIG. 5 is engaged to the upper end of a vertical arm of the swinging member 57 from the left. A horizontal arm of the sliding member 57 contacts the lower end of the spring-receiving member 55.

When the thread tension discs 30*a* and 30*b* are in the pressed state (tension operating state), the thread tension plate 39 is moved to the left. Since the actuating pin 59 is also moved to the left, the swinging member 57 is not rotated counterclockwise in rear view by the actuating pin 59 (refer to FIG. 5). Since the swinging member 57 does not move the spring-receiving member 55 upward, the tension adjustment plate 54 is pressed toward the support plate 50 by the spring force of the compression coil spring 56. Thus, pretension is applied to the needle thread 8 passing between the support plate 50 and the tension adjustment plate 54.

Figure 9:
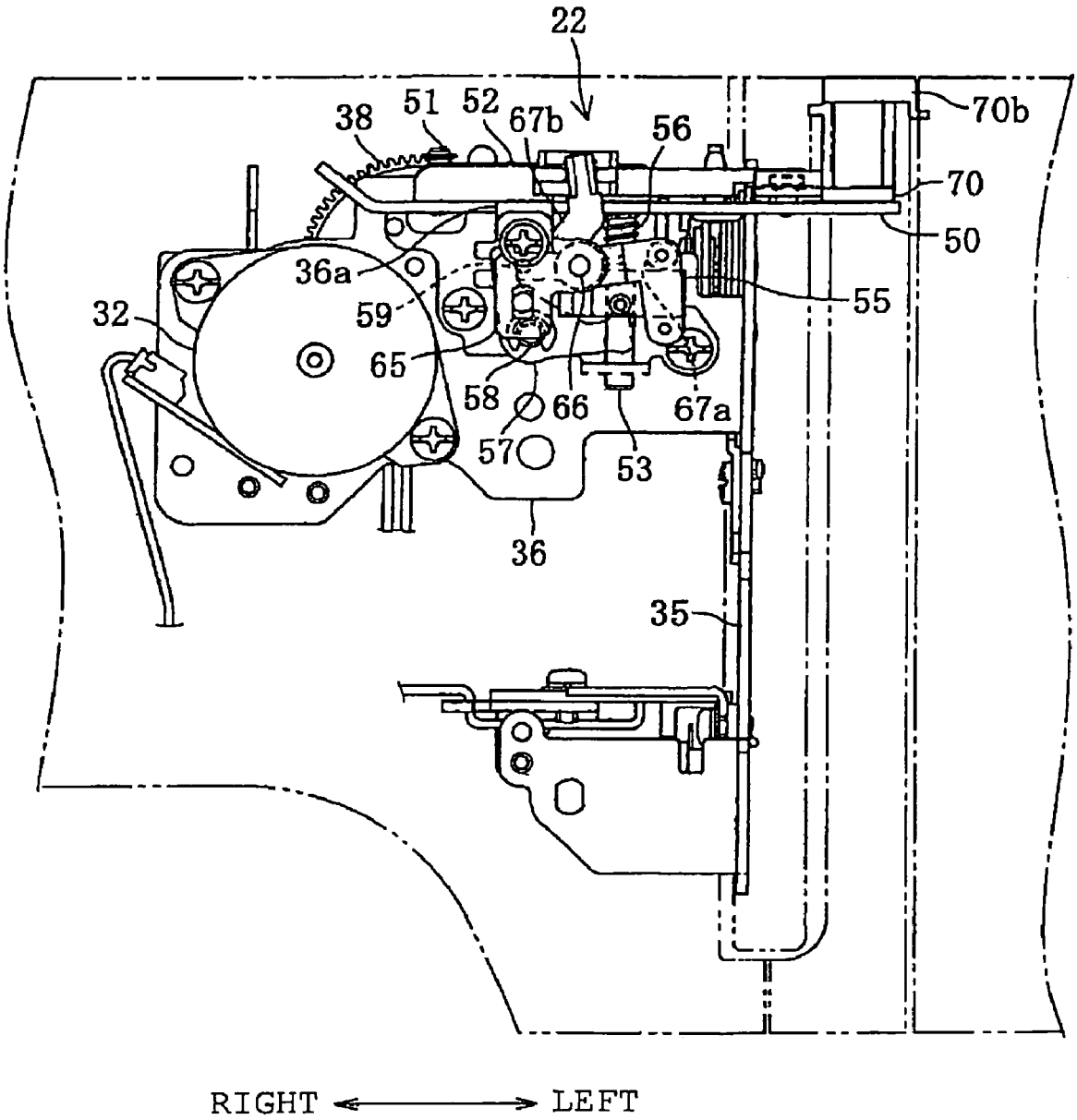
FIG. 9 shows a partial rear elevation view indicating an inner construction of an arm in case the covering member is in an opening position.

As opposed to this, when the tension of the thread tension discs 30*a* and 30*b* falls within the range of "zero" and the opened state (tension not operated), the thread tension plate 39 moves to the right. Since the actuating pin 59 accordingly moves to the right, the swinging member 57 is rotated counterclockwise in rear view (refer to FIG. 9). At this point, since the swinging member 57 moves the spring-receiving member 55 upward, the tension releasing pin 53 is moved upward. Therefore, the tension adjustment plate 54 is separated from the support plate 50 and pretension is no longer applied to the needle thread 8.

Next, the open-close drive mechanism 23 will be described hereinafter. A pivotal member 65 (refer to FIG. 5) in a substantially laterally-oriented T-shape in rear view is fixed to the rear surface of the support 50*a* of the support plate 50.

Figure 4:
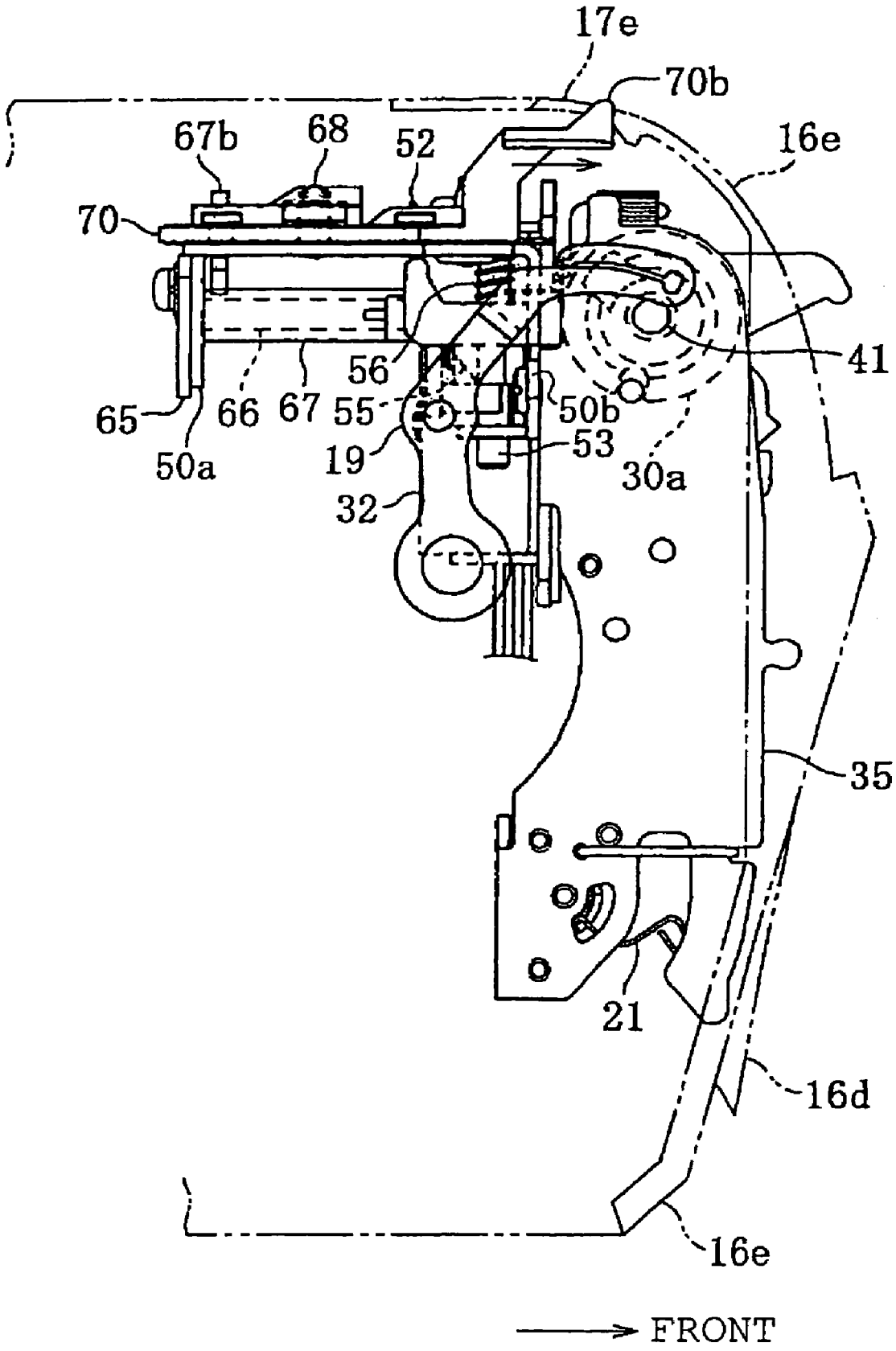
FIG. 4 shows a partial side view indicating an inner construction of an arm in case the covering member is in a closing position.

A pivotal shaft 66 extending in the longitudinal direction of the electronic sewing machine M has a rear end is secured to the pivotal member 65 (refer to FIG. 4). A swinging shaft member 67 is rotatably supported by the pivotal shaft 66.

A vertically paired picking pins 67*a* extending in the longitudinal direction of the electronic sewing machine M is integrally formed on the front end of the swing shaft member 67. The pair of picking pins 67*a* respectively contact the vertical ends of a spring-receiving member 55. Hence, the vertical movement of the spring-receiving member 55 rotates the swinging shaft member 67 about the rotational center of the pivotal shaft 66. A lever 67*b* extending upward is integrally formed on the rear end of the swinging shaft member 67.

A proximal end of a rotational lever 68 substantially L-shaped in flat view (refer to FIG. 2) is rotatably mounted on a pivotal pin 69 further mounted on the support plate 50. A first lever 68*a* extending towards the rear side (back side) of the rotational lever 68 is formed in a forked end. The lever portion 67*b* of the swinging shaft member 67 is in engagement with the forked end of the first lever 68*a*. A second lever 68*b* extending leftward is formed on the rotational lever 68.

A covering member 70 is arranged on the support plate 50 in the immediate left side of the rotational lever 68. The covering member 70 is in an approximate crank form extending in the front direction in flat surface view. Longitudinally paired elongate holes 70*a* are formed on a rear half of the covering member 70. These elongate holes 70*a* are respectively engaged with engagement pins 71 fixed on the support plate 50. Locking portions larger than a width of the elongate holes 70*a* are formed on upper ends of the engagement pins 71 respectively. The end point of the second lever 68*b* of the rotational lever 68 is connected to the covering member 70. The covering member 70 is supported such that the covering member 70 is movable in the longitudinal direction on the support plate 50 by the rotation of the rotational lever 68. At this point, since the locking portion of the engagement pin 71 locks the elongate holes 70*a*, the covering member 70 does not float up from the support plate 50.

A thread guiding cover 70*b* leveled higher than the rear end of the covering member 70 is formed on the front end of the covering member 70. A thread guide groove 17 is provided with a connecting path 17*e* in a portion corresponding to a portion above the thread take-up. The connecting path 17*e* is formed to connect the third thread guide groove 17*c* and the fourth thread guide groove 17*d* in the lateral direction. The thread guiding cover 70*b* opens or shields the connecting path 17*e* by the longitudinal movement of the covering member 70.

As described earlier, when the thread tension discs 30*a* and 30*b* are in the pressed state (tension operating state), the spring-receiving member 55 does not move upward via the swinging member 57 since the thread tension plate 39 and the actuating pin 59 are moved to the left. Accordingly, the swinging shaft 67 does not rotate. Since the swinging shaft member 67 does not rotate, the rotational lever 68 does not rotate. Therefore, the covering member 70 moves forward to the closed position, and the thread guide cover 70*b* covers the connecting path 17*e* (refer to FIGS. 2 and 4).

Figure 7:
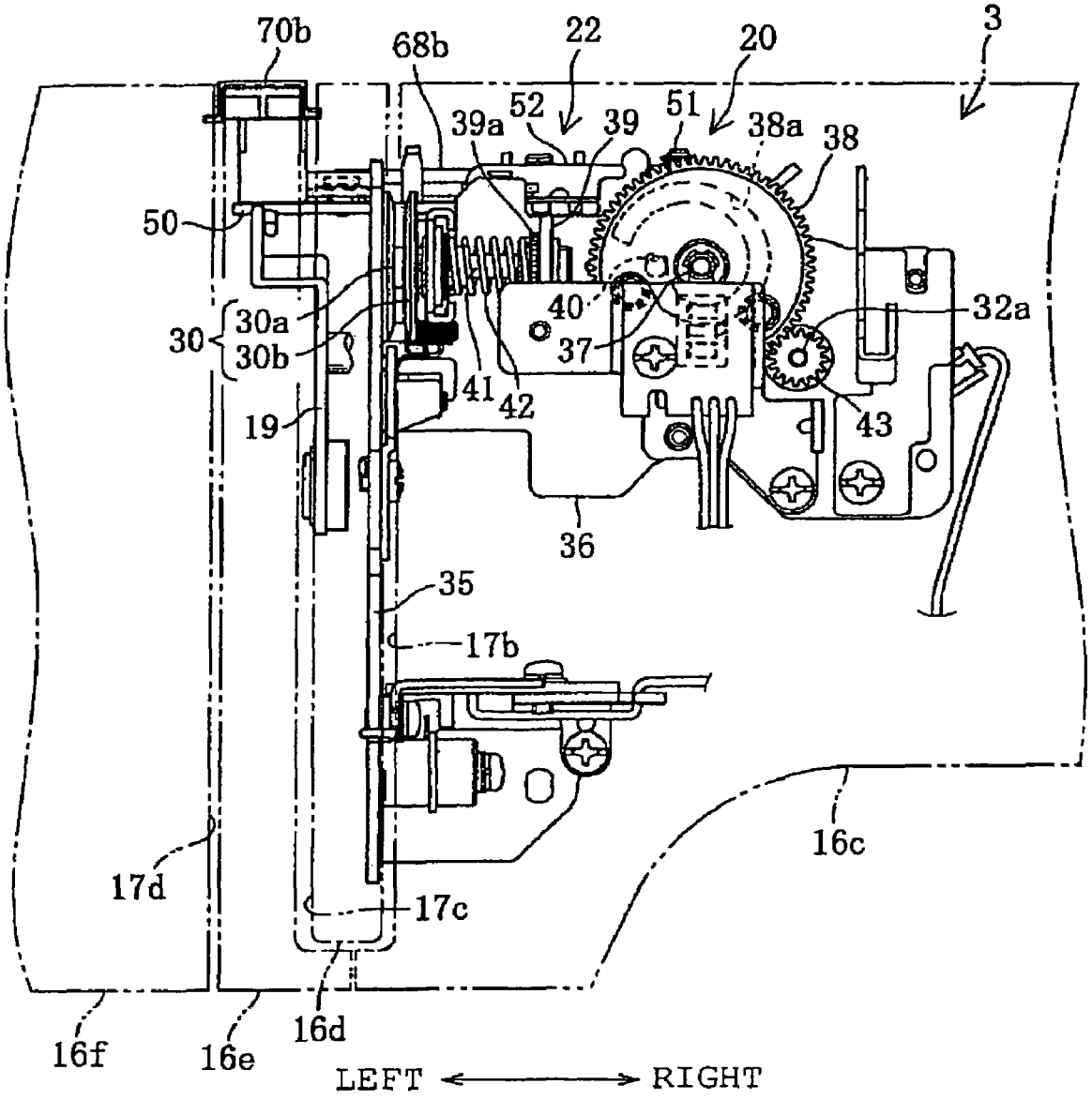
FIG. 7 shows a partial front view indicating an inner construction of an arm in case the covering member is in an opening position.
Figure 8:
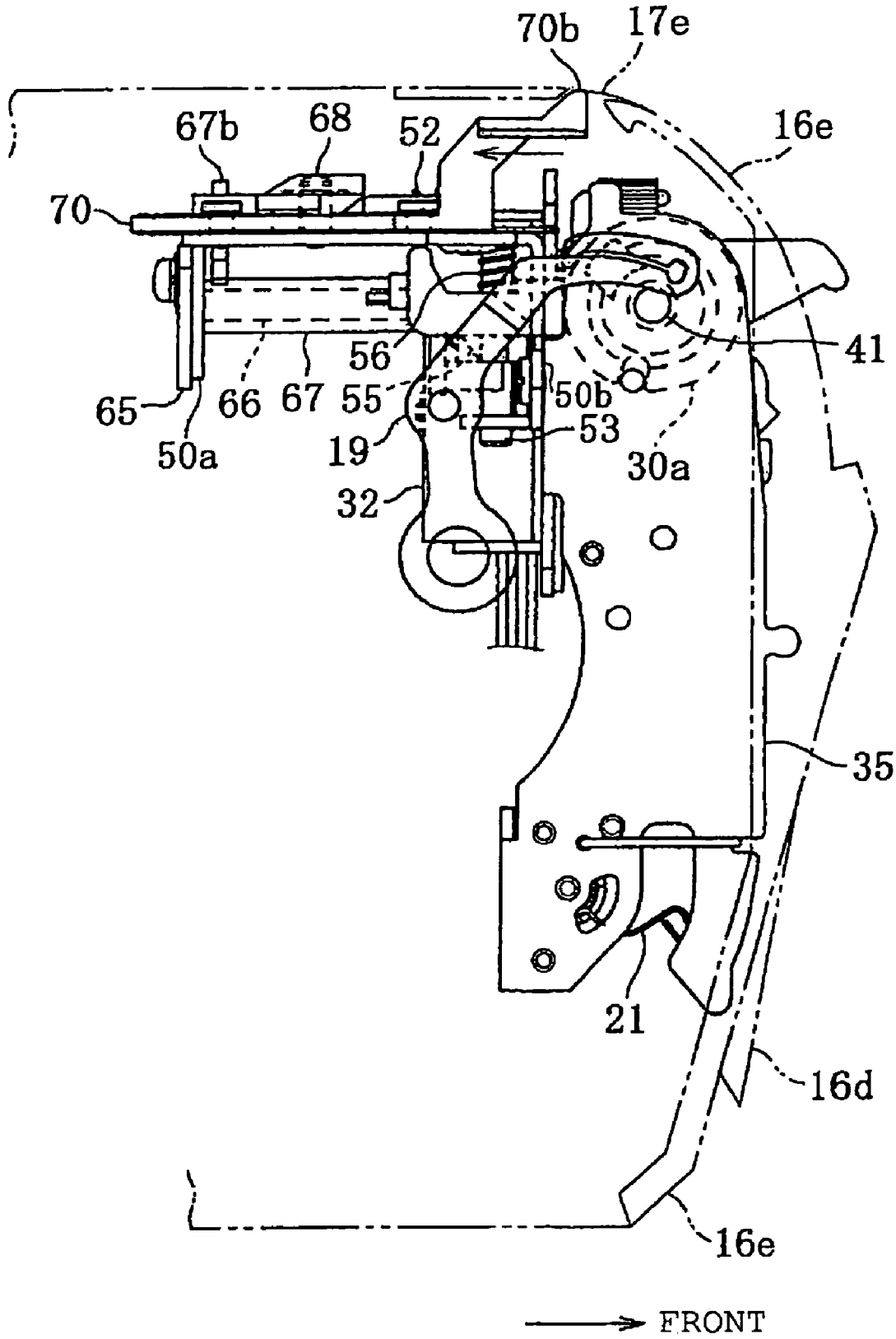
FIG. 8 shows a partial side view indicating an inner construction of an arm in case the covering member is in an opening position.

As opposed to this, when the thread tension plate 30*a* and 30*b* are in the opened state (tension not operated), the swinging member 57 is rotated counterclockwise in rear view (refer to FIG. 9) since the thread tension plate 39 and the actuating pin 59 are moved to the right. The spring-receiving member 55 is moved up by the rotation of the swinging member 57. When the spring-receiving member 55 is moved up, the swinging shaft member 67 is rotated clockwise in front view, and the rotational lever 68 is rotated counterclockwise in rear view. Therefore, the covering member 70 is moved rearward to the opened position (refer to FIGS. 6 and 7). Since the thread guide cover 70*b* is retracted reward, the connecting path 17*e* is opened. The user is now able to introduce the needle thread 8 from the third thread guide groove 17*c* to the fourth thread guide groove 17*d* via the connecting path 17*e*.

Figure 17:
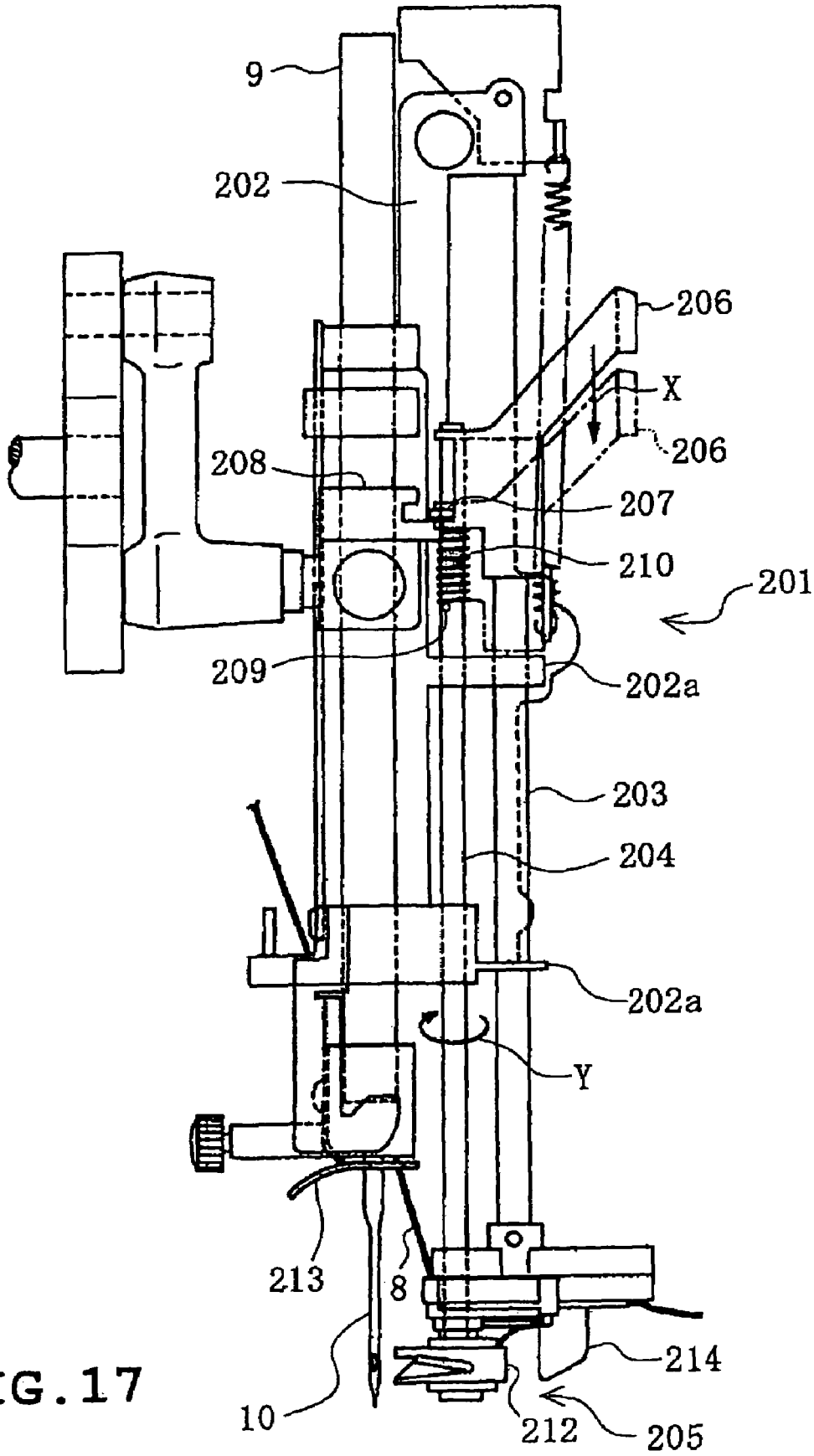
FIG. 17 shows a rear elevation view of a needle threading mechanism.

Next, a threading mechanism 201 will be described hereinafter. The threading mechanism 201 as shown in FIG. 17 includes an operation shaft 203, a threading shaft 204, and a hook mechanism 205. An operation body 206 is provided on the upper end of the operation shaft 203. A part of the operation body 206 is inserted into the upper end of the threading shaft 204 so as to be vertically movable. The operation body 206 is moved down (shown by arrow X in FIG. 17) in conjunction with the downward motion of the threading lever 24 (refer to FIG. 1). A sliding pin 207 perpendicular to the threading shaft 204 is provided on an upper end of the threading shaft 204. A rotational groove (not shown) slightly inclined axially with respect to the threading shaft 204 is provided on the operation body 206, and one end of the sliding pin 207 is slidably inserted into the rotational groove. The other end of the sliding pin 207 is capable of contacting a locating member 209 fixed to the needle bar 9. On the upper end of the threading shaft 204, a spring-receiving pin 209 is provided at a location below the sliding pin 207. The threading shaft 204 is provided with a coil spring 210 located between the spring-stopper pin 209 and the operation body 206, elastically supporting the operation body 206 with respect to the threading shaft 204. The operation shaft 203 and the threading shaft 204 are supported vertically movably by a support 202*a* provided in the needle bar base 202.

Figure 18:
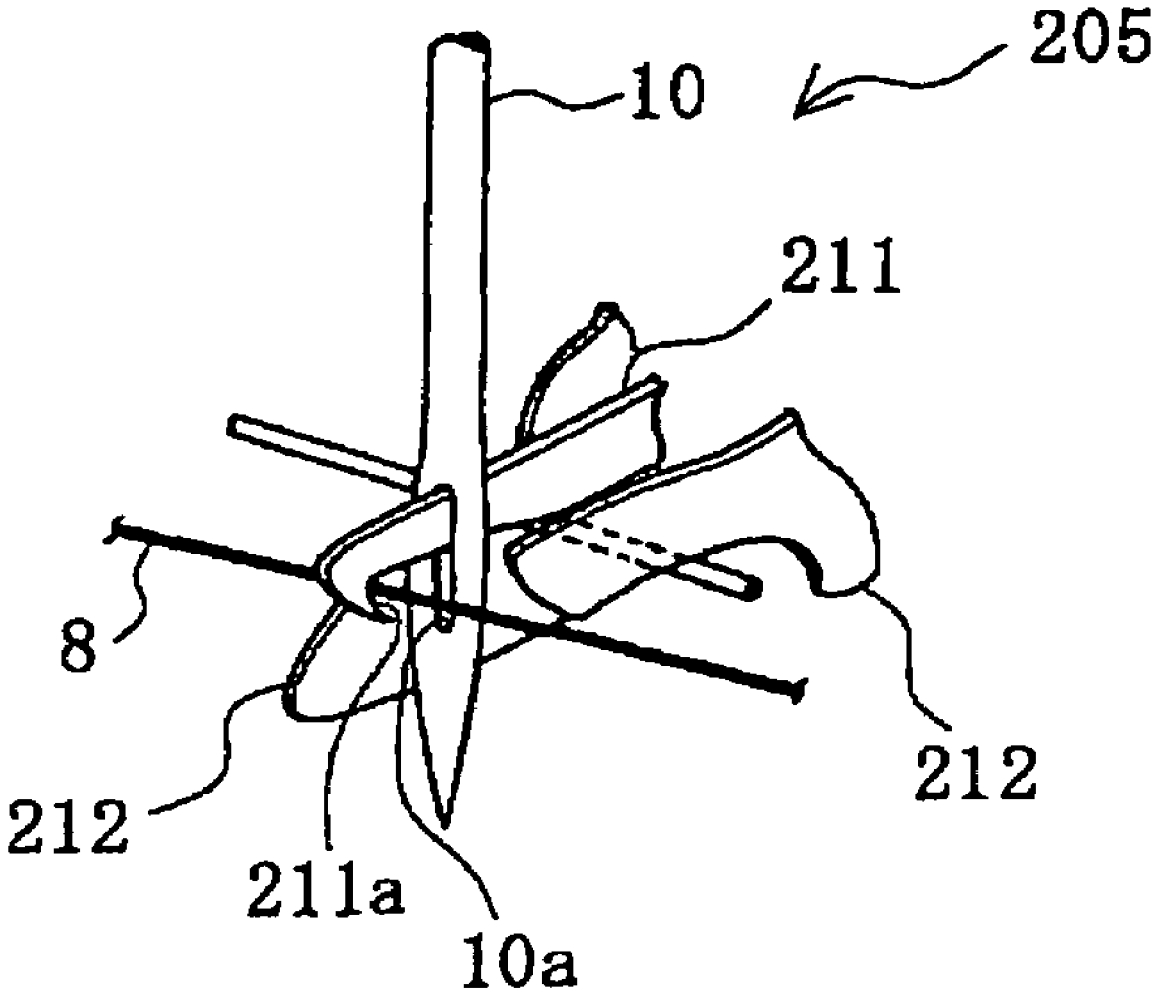
FIG. 18 shows a perspective view indicating a structure of a hook mechanism.

The hook mechanism 205 is provided on a lower end of the threading shaft 204. The hook mechanism 205 as shown in FIG. 18 includes a threading hook 211 and a pair of guide members 212. A hook 211*a* is provided on an end of the threading hook 211. Guide members 212 are arranged on the end of the threading hook 211 so as to hold the threading hook 211 therebetween.

Given the above construction, when the user operates the threading lever 24 downwards, the operation shaft 203 and the threading shaft 204 are lowered via the operation body 206, and the threading shaft 204 is moved to a location where the other end of the sliding pin 207 contacts the locating member 208. Along with further descent of the operation body 206, the operation shaft 203 is further lowered. At this point, one end of the sliding pin 207 provided on the threading shaft 204 slides along the rotational groove of the operation body 206. Therefore, the threading shaft 204 rotates along with the sliding pin 207 in the direction indicated by an arrow Y in FIG. 17, in the location contacting the locating member 208.

With rotation of threading shaft 204, the threading hook 211 is inserted to an eye 10*a* of the sewing needle 10 and the hook 211*a* is engaged to the upper thread 8. Then, from this state, when the user operates the threading lever 24 upwards, the threading shaft 204 rotates in the reverse direction to the arrow Y in FIG. 17. At this point, the hook 211*a* is pulled out of the eye 10*a* with the needle thread 8 still engaged. Thus, the eye 10*a* is threaded by the needle thread. The operation of the threading lever 24 in the vertical direction is detectable by a needle threading lever detection switch 109 corresponding to a needle threading lever detector.

Next, the needle thread hooking operation will hereinafter be described. As described above, in the opened state, the thread tension discs 30*a* and 30*b* do not apply any tension; pretension is not operated by the auxiliary thread tensioning mechanism 22; and the covering member 70 moves to the opened position. Hence, the user is allowed to perform the needle thread hooking operation which hooks the needle thread 8 on the thread take-up 19, thread tensioning mechanism 20, the thread take-up spring 21, and the like.

The user manually performs the needle thread hooking operation when the needle thread 8 breaks, or the thread spool 7 has been exchanged. Upon performing the needle thread hooking operation, the user inserts the needle thread 8 drawn from the thread spool 7 to the following in the subsequent sequence: laterally formed first thread guide groove 17*a*; downwardly formed second thread guide groove 17*b*; upwardly formed third thread guide groove 17*c*; and downwardly formed fourth thread guide groove 17*d*.

The user hooks the inserted needle thread 8 to the needle bar thread guide 213 (refer to FIG. 17), and the thread hooking member 214 (refer to FIG. 17). Then, the end of the needle thread 8 is trimmed by a trimmer 18 provided in the lower end of a face plate 16*f*, and the trimmed needle thread 8 is retained by a thread retainer (not shown) provided near the trimmer 18. Thus are completed preparatory work for performing the needle thread hooking operation of the needle thread 8 to the thread tension mechanism 20, the thread take-up 19 etc., and preparatory work for needle threading of the eye 10*a* of the sewing needle 10. Subsequently, when the user operates the threading lever 24 and actuates the needle threading mechanism 201, the needle thread 8 is threaded to the eye 10*a* of the sewing needle 10, and the electronic sewing machine M can now proceed to the sewing operation.

Next, the presser foot lifting mechanism 25 will be described which vertically moves the presser foot 12 by the presser foot lifting lever 76 (shown in FIGS. 10 and 11). Since the presser foot 12 as described above is attached to the lower end of the presser bar 11, the movement of the presser bar 11 will hereinafter be described.

A mounting frame 75 is fixed to a sewing machine frame beside the presser bar 11. The presser foot lifting lever 76 is rotatably mounted on a pivotal pin 77 further mounted on the mounting frame 75. The presser foot lifting lever 76 is provided with a vertically moving cam 76*a*. With rotation of the presser foot lifting lever 76, a cam surface of the vertically moving cam 76*a* abuts against a cam follower 78*a* formed integrally on the presser foot clamp 78. A handle 76*c* is provided on the presser foot lifting lever 76. An elongated detection plate 79 is supported on a pivotal pin 80 so as to be laterally rotatable. The pivotal pin 80 is further mounted on the mounting frame 75. The presser foot lifting lever 76 is provided with an actuating cam 76*b*. A lower end of the detection plate 79 contacts the actuating cam 76*b* via a follower pin 87. A presser foot lift detection switch 82 corresponding to a detector is mounted on the mounting frame 75 so as to correspond to an upper end of the detection plate 79. The detection plate 79 is normally urged clockwise by a torsion spring 81 provided on the pivotal pin 80, and is retained in an undetected position in which the presser foot lift detection switch 82 is OFF.

Figure 10:
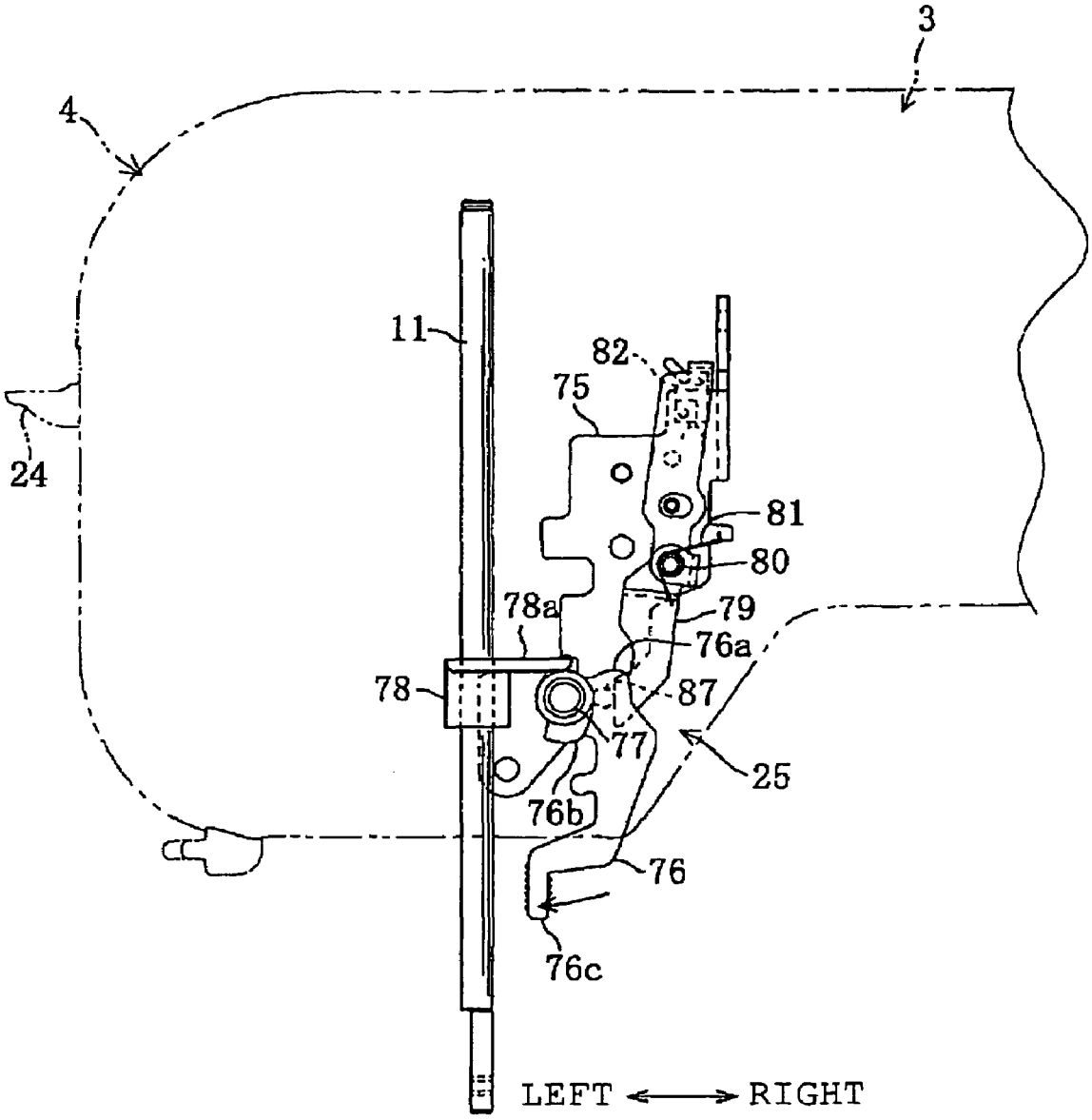
FIG. 10 shows a front view of a presser foot lifting mechanism in case the presser foot lever is in a lowered state.

In case the user presses down the presser foot lifting lever 76 by manually operating the handle 76*c*, as shown in FIG. 10, the cam surface of the vertically moving cam 76*a* does not contact the cam follower 78*a*. Therefore, the presser bar clamp 78 descends along with the presser bar 11. At this point, the detection plate 79 is in the undetected position via the follower pin 87. In this state, the presser foot lift detection switch 82 will not be turned ON.

Figure 11:
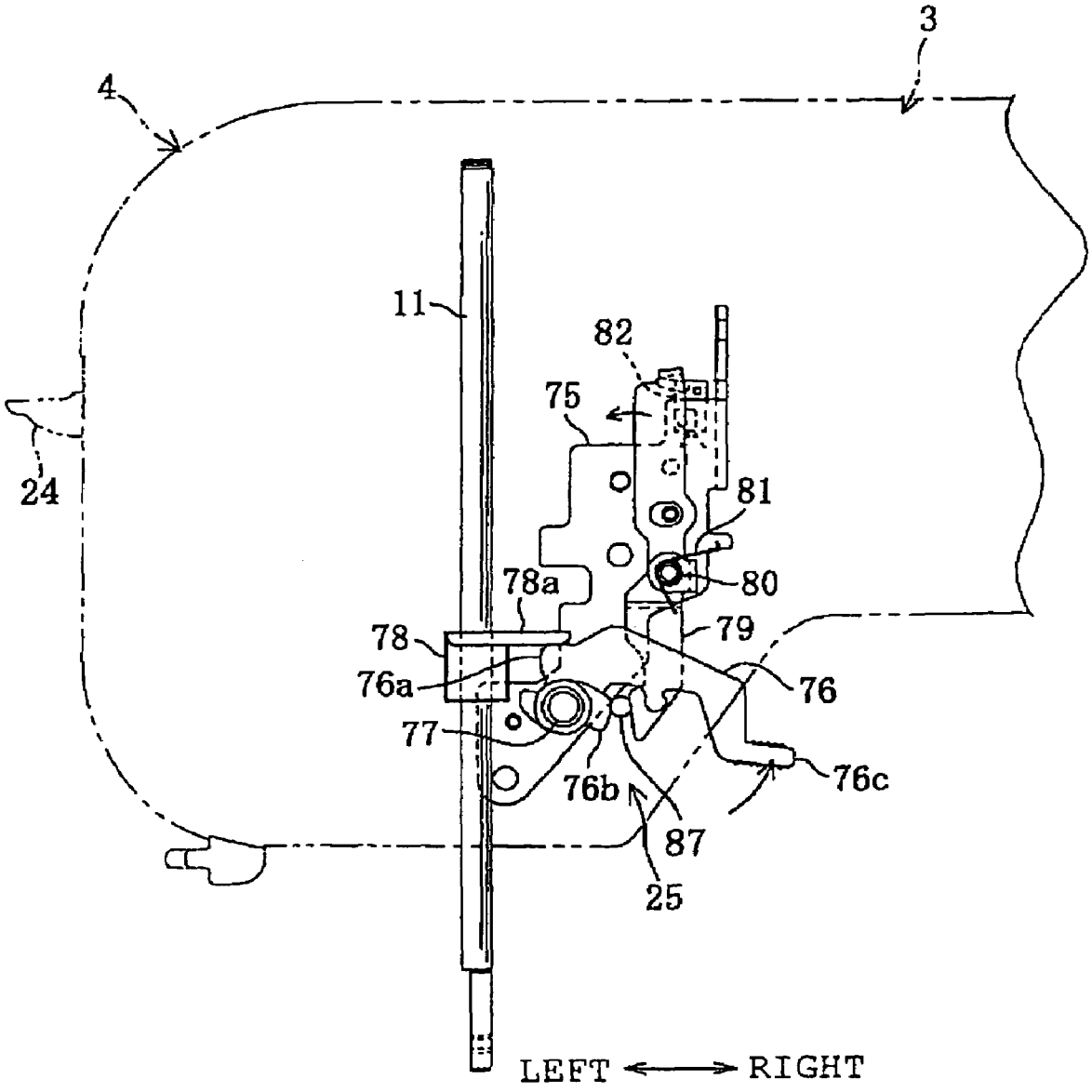
FIG. 11 shows a front view of a presser foot lifting mechanism in case the presser foot lever is in a lifted state.

As opposed to this, in case the user lifts the presser foot lifting lever 76, as shown in FIG. 11, the cam surface of the vertically moving cam 76*a* contacts the cam follower 78*a*. Therefore, the presser bar clamp 78 ascends along with the presser bar 11. At this point, the detection plate 79 is placed in the detected position via the follower pin 87. In this state, the presser foot lift detection switch 82 is pressed by the upper end of the detection plate 79 and turned ON.

That is, the lowering operation of the presser foot lever 76 can be detected by the corresponding OFF state of the presser lift detection switch. Also, the lifting operation of the presser foot lever 76 can be detected by the corresponding ON state of the presser lift detection switch.

The presser bar 11 is arranged vertically movably by the presser bar motor 83 (refer to FIG. 13) via the vertical moving mechanism (not shown). Therefore, upon embroidery sewing, the presser bar 11 can be vertically driven not only manually but also electrically as well, as will be described hereinafter.

Next, the thread trimming mechanism 85 (refer to FIG. 13) will be described. The thread trimming mechanism 85 is provided on the bed 1. Upon completion of the sewing process, the thread trimming mechanism 85 reciprocally moves the movable blade relative to the fixed blade by actuation of the thread trimming motor 86. The needle thread 8 and a bobbin thread are engaged with each other during the reciprocal movement so as to be both trimmed by co-operation of the movable and fixed blades.

Figure 12:
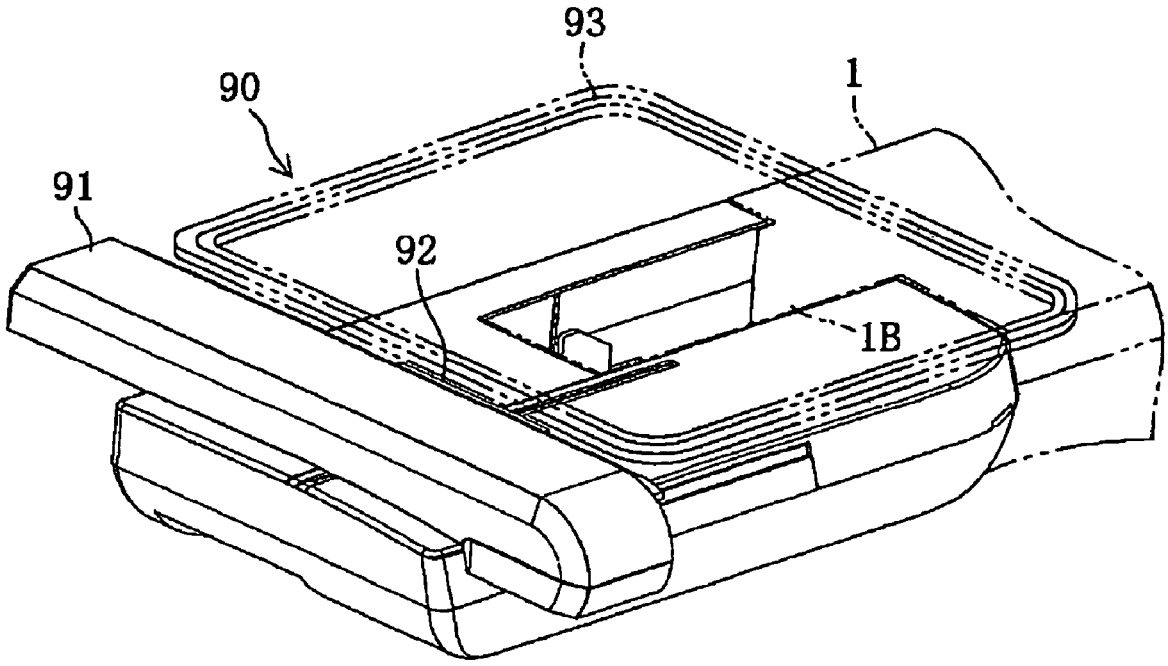
FIG. 12 shows a perspective view of an embroidery machine.

Next, the embroidery unit 90 will hereinafter be described. An auxiliary bed 1A is provided on the bed 1 of the electronic sewing machine M as shown in FIG. 1. The auxiliary bed 1A is generally formed into a C-shape extending from the front of the needle plate 5, then along the left end of the bed 1, and onto the back of the needle plate 5. The auxiliary bed 1A is detachably attached to the bed 1 from the left side. When the auxiliary bed 1A is removed from the bed 1, the electronic sewing machine M shows a free-arm sewing mode in which the free arm 1*b* is exposed. As shown in FIG. 12, an embroidery unit 90 used for embroidery sewing described hereinafter can be attached to the free arm 1B. At this point, the sewing machine unit 90 and the electronic sewing machine M are electrically connected to a control device 100 via a connector 117 (refer to FIG. 13). Thus, the electronic sewing machine M is used as an electronic embroidery sewing machine MA.

An X drive mechanism section (not shown) and Y drive mechanism section 91 are built into the embroidery unit 90 body. The X drive mechanism section includes an X drive mechanism and an X feed motor 94 (refer to FIG. 13). The Y drive mechanism section 91 includes a Y drive mechanism and a Y feed motor 95 (refer to FIG. 13). The X feed motor 94, the X drive mechanism, the Y feed motor 95, the Y drive mechanism, and the like constitute a frame drive mechanism 96 (refer to FIG. 13) corresponding to a frame driver. The frame drive mechanism 96 is moved by conjunctively moving the X drive mechanism section and the Y drive mechanism section 96.

A carriage 92 is provided on the Y drive mechanism section 91. An embroidery frame 93 is attached to the carriage 92. By moving an embroidery frame 93 via the frame drive mechanism 96, embroidery sewing is performed on the workpiece cloth retained by the embroidery frame 93.

Figure 13:
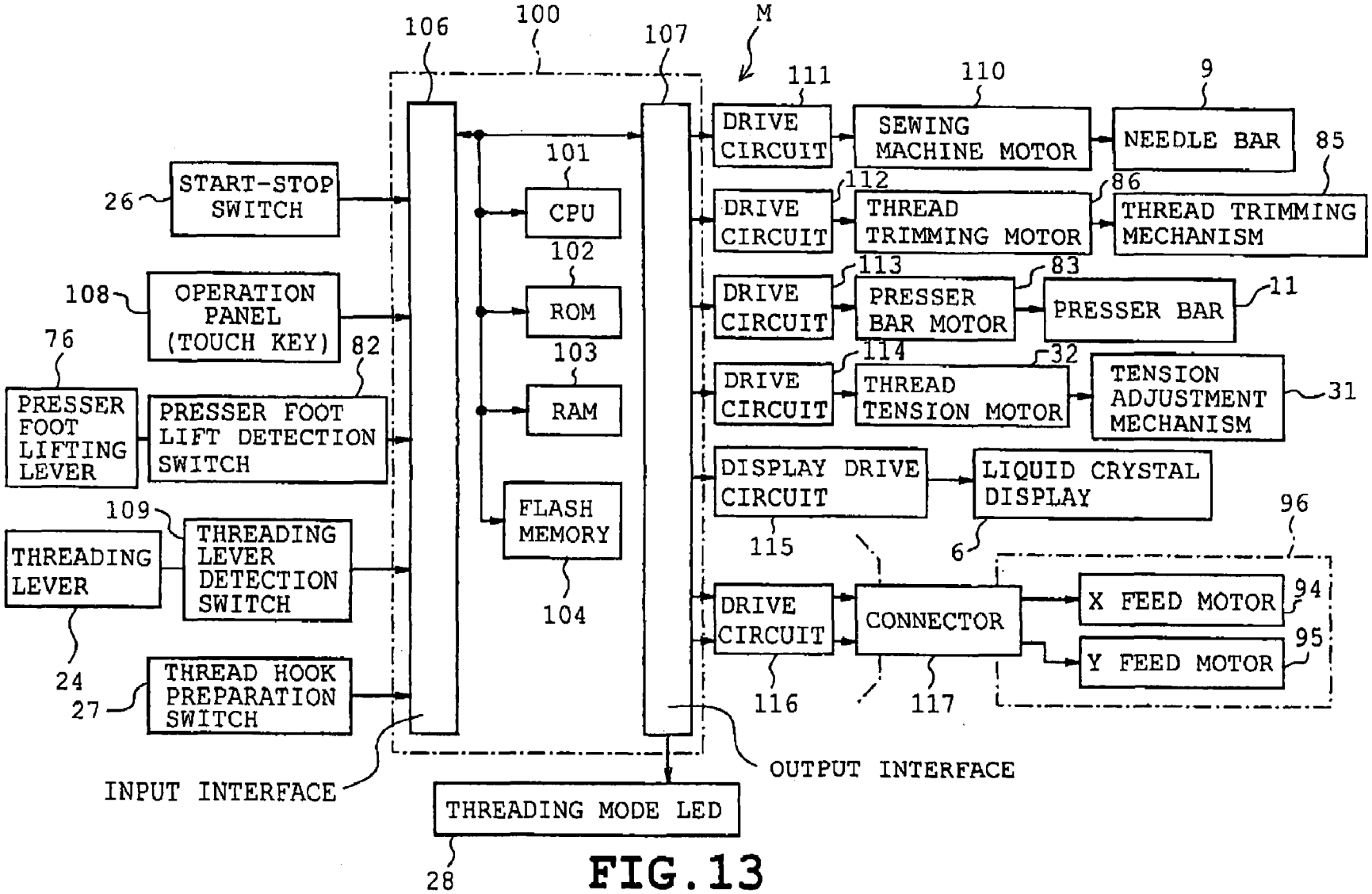
FIG. 13 shows a block diagram of a control system of the electronic sewing machine.

Next, an electrical system of the electronic sewing machine M will hereinafter be described with reference to a block diagram shown in FIG. 13. The control device 100 corresponding to a controller is configured by a microcomputer provided with a CPU 101, a ROM 102, a RAM 103, a flash memory 104, an input interface 106, an output interface 107, and the like. A data bus 105 connects the CPU 101, the ROM 102, the RAM 103, the flash memory 104, the input interface 106 and the output interface 107 sequentially.

In the ROM 102, utility stitch data, embroidery stitch data, a sewing control program, a thread hook preparation control program, and the like are stored. The utility stitch data is data for sewing a plurality of types of utility patterns by feeding the workpiece cloth via a feed dog (not shown). The embroidery stitch data is used for sewing plurality types of embroidery patterns by driving the frame drive mechanism 96 by attaching the embroidery unit 90 to the electronic sewing machine M. The sewing control program is used to control a sewing machine motor 110, the X feed motor 94, and the Y feed motor 95 based on the aforementioned stitch data. The thread hook preparation control program is used to prepare for performing the thread hook during utility sewing and embroidery sewing described hereinafter.

Figure 14:
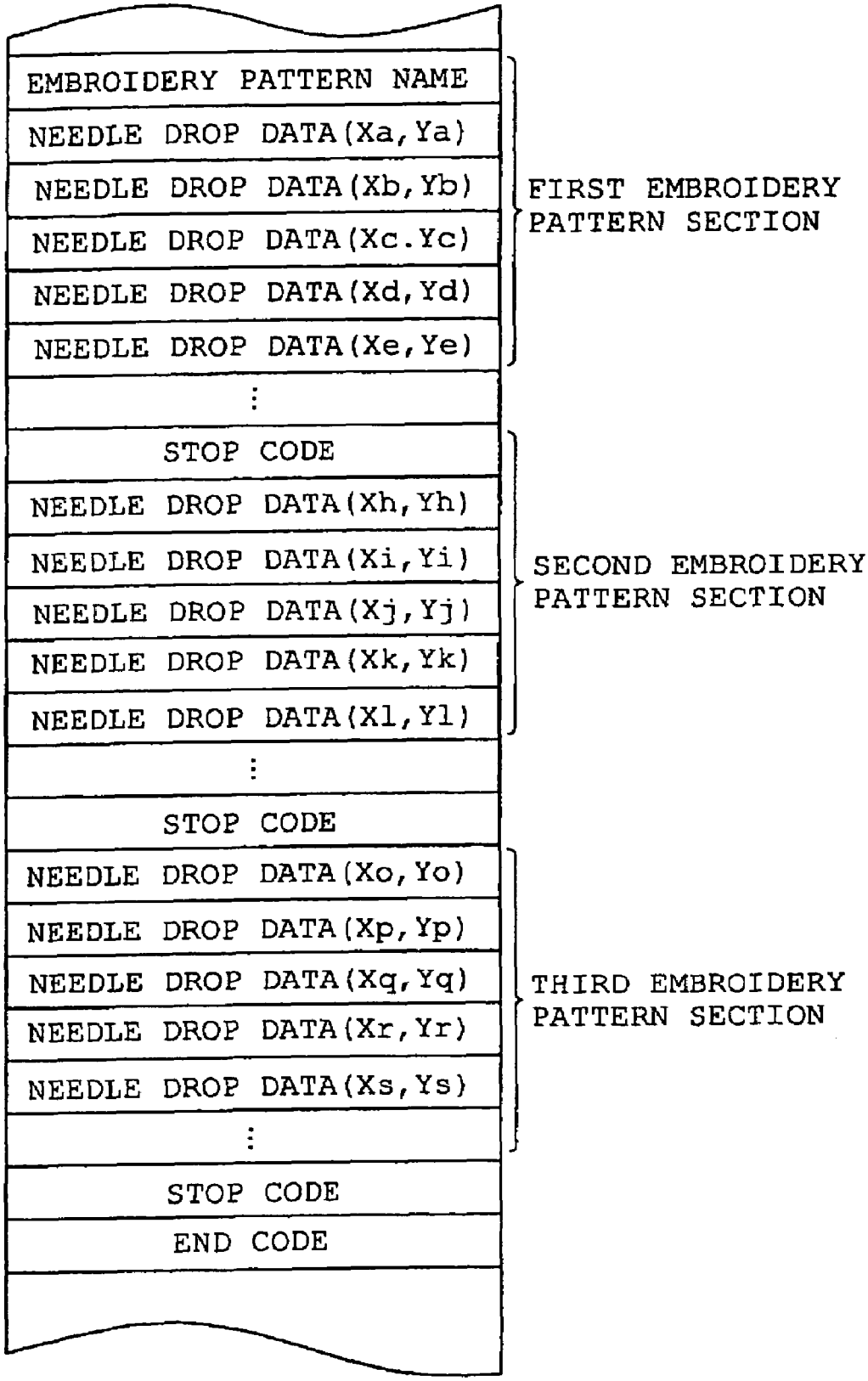
FIG. 14 shows a table describing a data structure of an embroidery data.

The embroidery stitch data described above includes, as shown in FIG. 14, an embroidery pattern name and a multitude of needle drop data pertaining to a plurality of embroidery pattern sections such as a first embroidery pattern section, a second embroidery pattern section. The embroidery pattern sections are categorized by each color of the thread forming the embroidery pattern.

A stop code is stored after each embroidery pattern section. The stop code temporarily stops the drive of the sewing machine motor 110 so that thread can be exchanged.

The RAM 103 is provided with a stitch data memory area that stores the utility stitch data and embroidery stitch data which have been read, various work memory area, and various buffer areas or the like to temporarily store the calculation results of the CPU 101.

To the input interface 106 are connected a start-stop switch 26 (refer to FIG. 1), a thread hook preparation switch 27 (refer to FIG. 1), an operation panel 108 having touch keys, the presser foot lift detection switch 82 (refer to FIG. 10), and needle threading lever detection switch 109 and the like. The operation panel 108 is arranged so as to cover the surface of a liquid crystal display 6 (refer to FIG. 1).

To the output interface 107 are connected a threading mode LED 28, drive circuits 111 to 114 and 116, a display drive circuit 115 and the like. The threading mode LED 28 displays whether needle threading is possible or not. The drive circuit 111 drives the sewing machine motor 110 that vertically moves the needle bar 9. The drive circuit 112 drives the thread trimming motor 86 that activates the thread trimming mechanism 85. The drive circuit 113 drives the presser bar motor 83. The drive circuit 114 drives the thread tension motor 32 that activates the tension adjusting mechanism 31. The display drive circuit 115 drives the liquid crystal display 6. The drive circuit 116 drives the X feed motor 94 and the Y feed motor 95 provided on the frame drive mechanism 96 of the embroidery unit 90.

Figure 15:
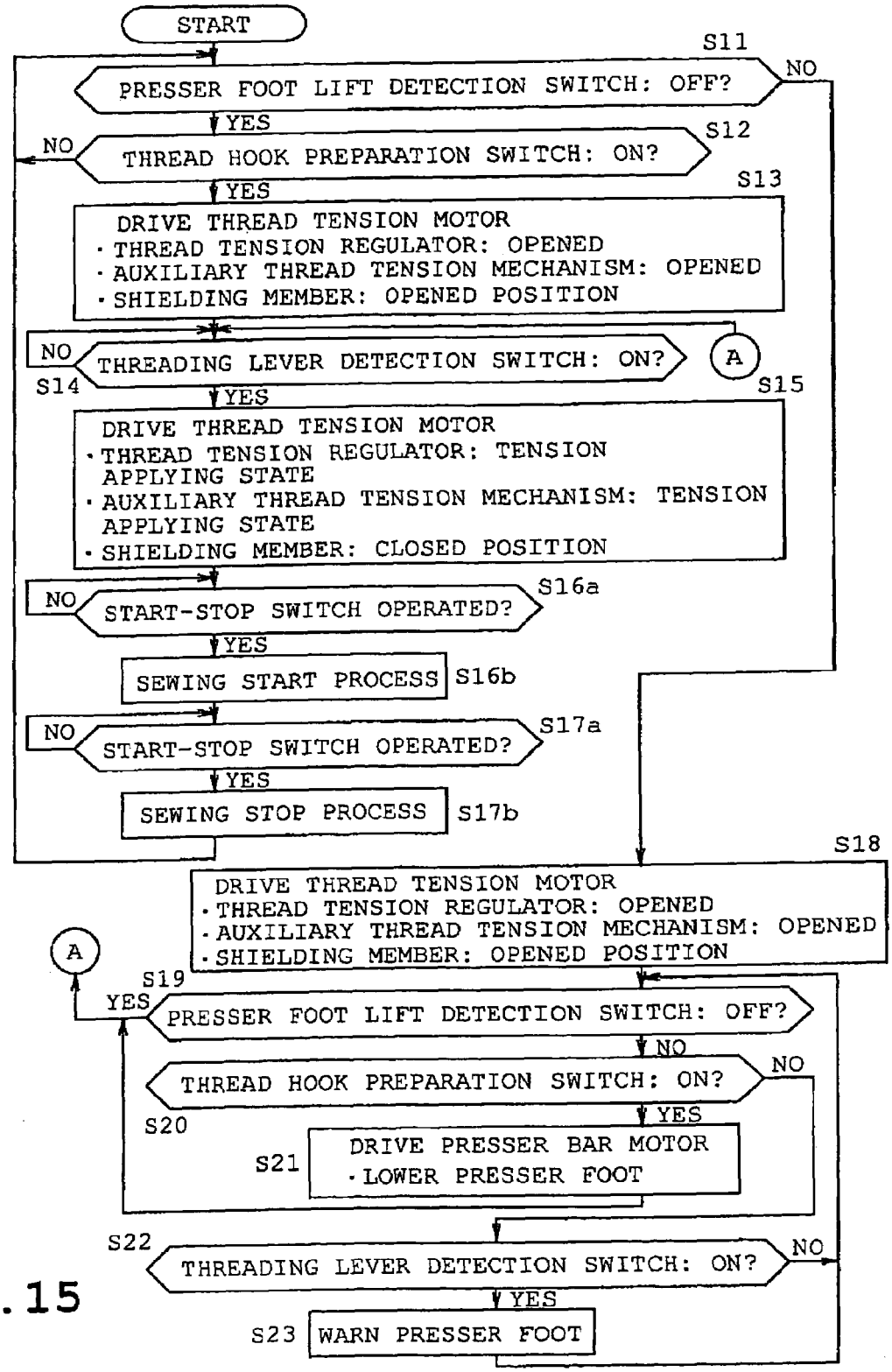
FIG. 15 shows a flow chart of a thread hook preparation control for utility sewing.

The following describes a thread hook preparation control conducted by the control device 100 of the electronic sewing machine M upon utility sewing executed, with reference to a flow chart shown in FIG. 15. Indications Si (i=11, 12, 13 . . . ) identify each step number.

First, initial setting carried out in prior to the thread hook preparation control will be described hereinafter. The thread tension motor 32 described above, is constructed by a stepping motor. When power is supplied to the electronic sewing machine M by the user, the control device 100 performs the initial setting. In the initial setting, the thread tension motor 32 is rotationally driven to an initially set location where the tension applied by the thread tension discs 30*a* and 30*b* becomes approximately "zero". Considering this initially set location as "0 pulse", the thread tension can be adjusted in the range of "0 pulse" to "+144 pulse".

As opposed to this, when the thread tension motor 32 rotates to "−20 pulse", the thread tension discs 30*a* and 30*b* are spaced apart from each other via the tension adjustment gear 38, and the tension applied by the thread tension discs 30*a* and 30*b* becomes "zero". The thread tension regulator 30 and the auxiliary thread tension mechanism 22, as well are opened, and the covering member 70 is driven to the opened position. As a result, the thread introductory cover 70*b* is also retracted and the connecting path 17*e* becomes opened.

When the power is supplied and the initial setting is completed, the control device 100 starts the above described thread hook preparation control. The control device 100 reads a switch signal of the presser foot lift detection switch 82 (S11). In case the presser foot 12 is lowered, and the presser foot lift detection switch 82 is turned OFF, the control device 100 makes the "YES" decision and proceeds to S12 in which a switch signal of the thread hook preparation switch 27 is read. In case the thread hook preparation switch 27 is operated and turned ON, the control device 100 makes the "YES" decision and drives the thread tension motor 32 (S13) based on a thread hook preparation instruction from the thread hook preparation switch 27. This drive opens the thread tension regulator 30 of the thread tension mechanism 20 as well as the auxiliary thread tension mechanism 22 and the covering member 70 is driven to the opened position. At this point, the needle threading mode LED 28 provided on the arm 3 is illuminated in "green", and a start permission LED (not shown) is illuminated in "red" by the control device 100 which indicates that the sewing machine cannot be started.

In this state, the user can normally hook the needle thread 8 supplied from the thread spool 7 to the auxiliary thread tension mechanism 22, thread tension regulator 30, and the thread take-up 19 which are located below the thread guide groove 17 (17*a* to 17*d*). Then, the end of the needle thread 8 is trimmed by the trimmer 18 provided in the lower end of the surface plate 16*f*, and the end of the trimmed needle thread 8 is retained by the thread end retainer(not shown) provided near the trimmer 18. Thus, the preparation for threading the eye of the sewing needle 10 with the needle thread 8 by the threading mechanism 201 (refer to FIG. 17) is completed.

Next, when the user lowers the needle threading lever 24, the needle thread lever detection switch 109 is turned "ON". When the needle threading lever detection switch 109 is turned ON (S14: YES), the control device 100 drives the thread tension motor 32 (S15). Thus, the thread tension regulator 30 and the auxiliary thread tension mechanism 22 are in condition to apply a tension, and the covering member 70 is driven to the closed position. As a result, tension is applied to the needle thread 8 engaged to the needle threading hook 211. The thread introductory cover 70*b* is moved to the closed position where the connecting path 17*e* of the thread guide groove 17 is covered. Thus, since thread hooking and needle threading are completed, by the user's placement of the workpiece cloth to be sewn on the bed 1, and by operating the start-stop switch 26, sewing can be started.

The control device 100 determines whether start-stop switch 26 is operated or not (S16*a*). If the user operates the start-stop switch 26, the control device 100 makes the "YES" decision, executes a sewing start process (S16*b*), and sewing machine motor 110 is driven to start utility sewing.

When utility sewing is started, the control device 100 determines whether the start-stop switch 26 is operated or not (S17*a*). From this state, if the user operates the start-stop switch 26 again, the control device 100 makes the "YES" decision, executes a sewing stop process (S17*b*), and the drive of the sewing machine motor 110 is stopped. After stopping the sewing machine motor 110, the control device 100 proceeds to the above described S11.

When the thread hook preparation control is started, in case the presser foot 12 is in a lifted position, the presser foot lift detection switch 82 is turned ON. At this point, the control device 100 makes the "NO" decision in step S11, and drives the thread tension motor 32 (S18). Hence, the thread tension regulator 30 of the thread tension mechanism 20, as well as the auxiliary thread tension mechanism 22 are opened. Also, the covering member 70 is driven to the opened position. Consequently, the thread introductory cover 70*b* is retracted from the thread guide groove 17 (connecting path 17*e*). That is, the entire thread guide groove is opened, and in this state, the user can perform the thread hooking operation along the thread guide groove 17.

In case the user lowers the presser foot lifting lever 76 after completion of the thread hooking operation, the presser foot 12 is moved to the lowered position. At this point, the presser foot lift detection switch 82 is turned OFF. In this state, the control device 100 makes the "YES" decision in step S19 and proceeds to Step S14. As opposed to this, in case the user does not lower the presser foot lifting lever 76 after completion of the thread hook operation, the presser foot 12 is maintained in the lifted position. At this point, the presser foot lift detection switch 82 stays ON. In this case, the control device 100 proceeds to step S20, and determines whether the thread hook preparation switch 27 is operated or not. If the thread hook preparation switch 27 is operated by the user, the control device 100 proceeds to step S21, and drives the presser bar motor 83. Thus, the presser foot 12 is lowered to the lowered position and the interference between the presser foot 12 and needle threading mechanism 201 is prevented. After that, the control device 100 proceeds to the above described step S14.

On the other hand, in a situation where the thread hook preparation switch 27 is not operated in the above described step S20, the control device 100 proceeds to step S22 to determine whether the needle threading lever detection switch 109 is turned ON or not. In case the user lowers the needle threading lever 24, the needle threading lever detection switch 109 is turned ON. In this state, each of the presser foot 12 and the needle threading mechanism 201 will interfere with the other. Hence, the control device 100 displays a warning message to the liquid crystal display 6 demanding the lowering of the presser foot 12 (S23). Based on this warning message, the user can lower the presser foot 12 by operating the presser foot lifting lever 76 or by operating the thread hook preparation switch 27.

Figure 16:
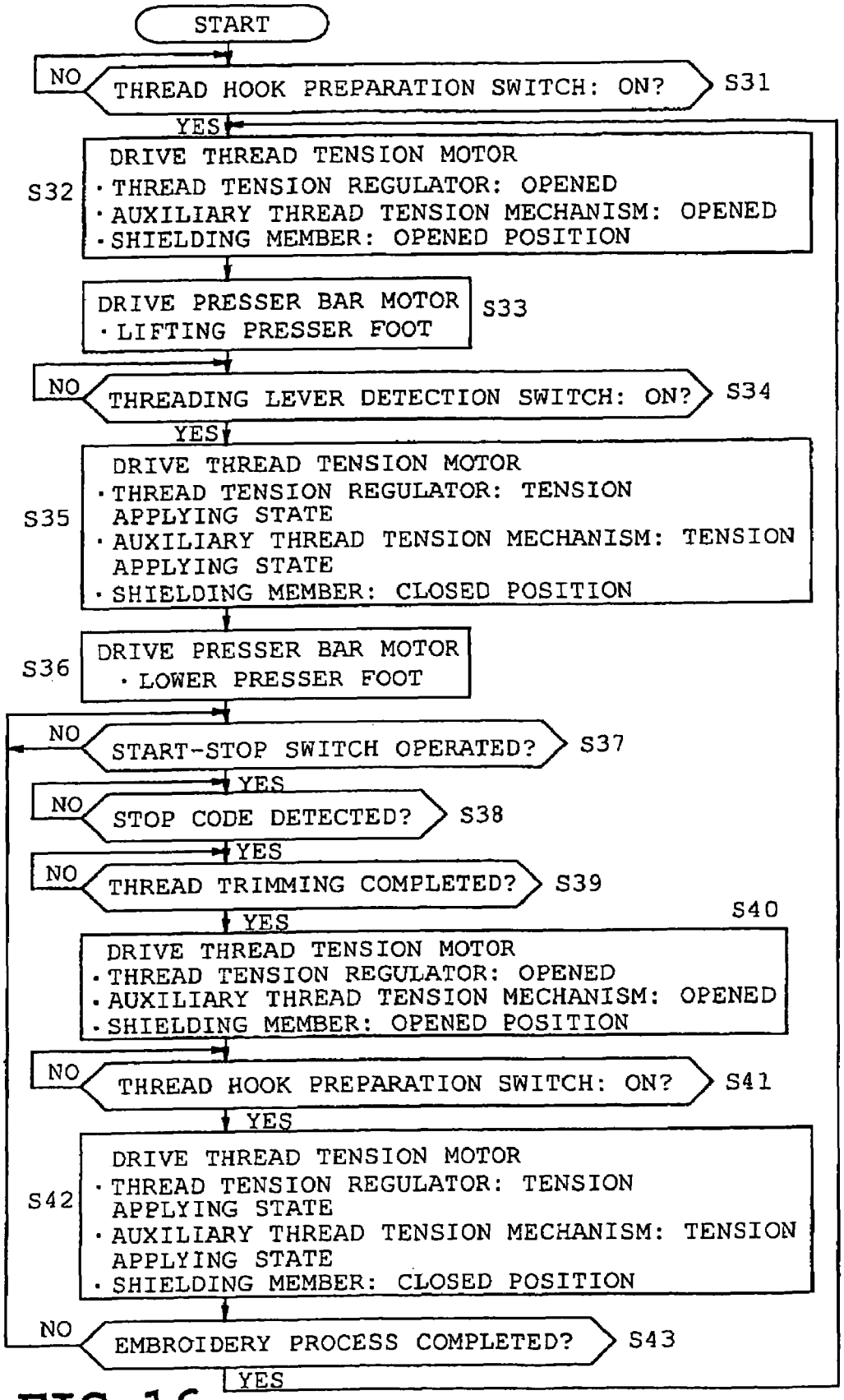
FIG. 16 shows a flow chart of a thread hook preparation control for embroidery sewing.

The following describes the thread hook preparation control in case of embroidery sewing by the embroidery sewing machine MA, with reference to a flow chart shown in FIG. 16.

The control device 100 starts this control when power is supplied thereto. The control device 100 first reads the switch signal of the thread hook preparation switch 27 (step S31). In case the thread hook preparation switch 27 is ON, the control device 100 makes the "YES" decision, proceeding to step S32 in which the thread tension motor 32 is driven. This drive releases the thread tension regulator 30, as well as the auxiliary thread tension mechanism 22, and the covering member 70 is driven to the opened position. Consequently, the thread introductory cover 70*b* is retracted from the thread guide groove 17 (connecting path 17*e*). That is, the entire thread guide groove is opened, and in this state, the user can perform the thread hooking operation of the needle thread 8 along the thread guide groove 17.

Next, the control device 100 proceeds to step S33 and the presser foot 12 is lifted to the lifted position by driving the presser bar motor 83. In this state, the embroidery frame 93 becomes movable, and the user can move the workpiece cloth to the sewing start position. Then, the control device 100 determines whether the needle threading lever detection switch 109 is turned ON or not (S34). If the user lowers the needle threading lever 24, and the needle threading lever detection switch 109 is turned ON, the control device 100 makes the "YES" decision and proceeds to step S35, and the thread tension motor 32 is driven. This drive puts the thread tension regulator 30 and the auxiliary thread tension mechanism 22 in a tension applying state, and the covering member 70 is driven to the closed position. As a result, the thread introductory cover 70*b* is moved to the closed position that covers the connecting path 17*e* of the thread guide groove 17.

Then, the control device 100 proceeds to step S36 to drive the presser bar motor 83. Thus, the presser foot 12 is lowered to a sewing location slightly higher than the lowered position, and thread hooking is completed. Then, the user operates the start-stop switch 26 after attaching the embroidery frame 93 to the embroidery unit 90. When the start-stop switch 26 is operated, the control device 100 makes the "Yes" decision in step S37, and starts embroidery sewing while reading the embroidery stitch data (refer to FIG. 14).

When the control device 100 detects the stop code in the final portion of each embroidery pattern (S38: YES), the drive of the sewing machine motor 110 is stopped, embroidery sewing is interrupted, and whether thread trimming by the thread trimming mechanism 85 has been completed or not is determined (S39). If the control device 100 determines that the thread trimming by the thread trimming mechanism 85 has been completed (YES), the thread tension motor 32 is driven (S40) for exchange of the needle thread 8. Thus, the thread tension regulator 30 and the auxiliary thread tension mechanism 22 are simultaneously opened, and the covering member 70 is driven to the opened position. Consequently, the thread introductory cover 70*b* is retracted from the thread guide groove 17 (connecting path 17*e*). In this state, the user can perform the thread hook operation of the needle thread 8 along the thread guide groove 17.

Then, the control device 100 determines whether the needle threading lever detection switch 109 is turned ON or not (S41). After completion of thread hooking operation, when the user operates the needle threading lever 24, the needle threading lever detection switch 109 is turned ON. The control device 100 proceeds to step S42, and drives the thread tension motor 32. Thus, the thread tension regulator 30 and the auxiliary thread tension mechanism 22 are in condition to apply a tension, and the covering member 70 is driven to the closed position.

In case the control device 100 continues to read data for subsequent embroidery pattern section, it is determined that the embroidery sewing process is not finished (S43: NO), and the process proceeds to S37. On the other hand, in case the control device 100 reads an end code, the entire embroidery process is determined to have been finished (S43: YES), and the sewing machine motor 110 is stopped. After stopping the sewing machine motor 110, the control device 100 proceeds to the above described step S32 to open the thread tension regulator 30. At this point, the auxiliary thread tension mechanism 22 is also opened, and the covering member 70 is driven to the opened position. Thus, since the connecting path 17*e* is opened, the user is able to promptly perform the thread hooking operation of the needle thread 8 for subsequent sewing process.

As described above, according to the foregoing embodiment, when the lifting of the presser foot lifting lever 76 is detected by the presser foot lift detection switch 82, the control device 100 controls the thread tension motor 32 so that the covering member 70 moves to the opened position. Consequently, the connecting path 17*e* of the thread guide groove 17 switched from the covering state to the opened state, thread guide groove 17 is uncovered, and the user is able to at least hook the thread on the thread tension regulator 30. Since the covering member 70 moves to the opened position by the drive force of the thread tension motor 32, the force required to lift the presser foot lifting lever 76 is reduced, thereby improving the operability.

Furthermore, since the movement of the covering member 70 to the opened position is performed in conjunction with the drive of the thread tension motor 32, there is no need for the connection of multitude of members such as cams, connection members, mounting members, and the like. Therefore, the covering member 70 can be moved to the opened position by the opening-and-closing mechanism 23 having fewer parts, thereby enabling the cost reduction of the opening-and-closing drive mechanism.

Since the thread tension motor 32 is used not only for driving the covering member 70 but also for controlling the thread tension regulator 30, there is no need for a dedicated drive source for each of the covering member 70 and the thread tension regulator 30. Therefore, the number of parts to drive each mechanism can be reduced, providing even more cost reduction.

When the presser foot detection switch 82 detects the lifting of the presser foot lifting lever 76, the control device 100 controls the thread tension motor 32 so as to open the thread tension regulator 30. The user does not normally lift the presser foot lifting lever 76 during embroidery work; therefore the thread tension regulator 30 is not opened during embroidery work. In this state, the needle thread 8 is accordingly applied with optimal tension for the sewing process, which provides stability in the needle thread 8 while the user performs the sewing process.

When the presser foot lifting lever 76 is lifted, the covering member 70 is moved to the opened position, and the thread tension regulator 30 is opened. In this state, the user is allowed to immediately hook the needle thread 8 onto the opened thread tension regulator 30. This offers improved operability to the user in performing the thread hook operation for thread exchange which is carried out upon completion of the sewing process.

When the presser foot lift detection switch 82 detects the lifting of the presser foot lifting lever 76, the control device 100 controls the thread tension motor 32 so that the auxiliary thread tension mechanism 22 in addition to the thread tension regulator 30. Therefore, the user can hook the thread not only to the thread tension regulator 30 but also the auxiliary thread tension mechanism 22 by lifting the presser foot lifting lever 76.

When the thread hook preparation switch 27 is operated, the covering member 70 is driven to the opened position, and the thread tension regulator 30 is opened. That is, the user is able to move the covering member 70 to the opened position, and open the thread tension regulator 30 not only by the lifting of the presser foot lifting lever 76, but also by the operation of the thread hook preparation switch 27. Thus, the operability of thread hooking operation is improved.

The thread tension motor 32 also moves the covering member 70 from the closed position to the opened position in addition to moving the same from the opened position to the closed position. When the presser foot lift detection switch 82 detects the lowering operation of the presser foot lifting lever 76, the control device 100 controls the thread tension motor 32 so that the covering member 70 is moved to the closed position. Therefore, the user is able to move the covering member 70 to the closed position by pressing down the raised presser foot lifting lever 76.

When the operation of the needle threading lever 24 is detected by the needle threading lever detection switch 109, the control device 100 moves the covering member 70 to the closed position, as well as controlling the thread tension motor 32 so that the tension applied to the needle thread 8 by the thread tension regulator 30 is adjusted to the predetermined tension. Therefore, when the user operates the needle threading lever 24 upon threading the needle with the needle thread 8, the covering member 70 is moved to the closed position, and the thread tension regulator 30 is closed, with the needle thread 8 in thread-hooked state. Consequently, a predetermined tension is applied to the portion of the needle thread 8 ranging from the thread tension regulator 30 to the needle threading mechanism 201, without loosening of the needle thread B. In this state, the user is able to smoothly perform the needle threading process by the needle threading mechanism 201, and immediately start the sewing process upon completion of needle threading.

The thread guide groove 17 is formed so as to guide the needle thread 8 to the thread tension regulator 30 and to the thread take-up 19 and the take-up spring 21 as well which are arranged downstream with respect to the thread tension regulator 30. The covering member 70, when moved to the closed position, is arranged to cover the connecting path 17*e* which is a part of the thread guide groove 17 and which corresponds to the portion above the thread take-up 19. The covering member 70 covers the portion above the thread take-up 19 in cases where thread hooking is inappropriate, such as when the presser foot 12 is lowered, or when the user stops the electronic sewing machine M during embroidery pattern sewing. Therefore, the user's attempt to guide the needle thread 8 to the thread take-up 19 and the take-up spring 21 will fail since the needle thread 8 is blocked by the covering member 70. Thus, the user can easily and reliably notice that thread hook cannot be performed on the electronic sewing machine M.

Also, in an embroidery sewing machine MA provided with a frame driving mechanism 96, the thread tension motor 32 is driven upon completion of embroidery sewing, and the covering member 70 is driven to the opened position. That is, the movement of the covering member 70 to the opened position is not carried out in conjunction with the lifting of the presser foot lifting lever 76. Instead, the movement of the covering member 70 to the opened position is carried out automatically by the drive force of the thread tension motor 32 upon completion of embroidery sewing. Therefore, the covering member 70 can be moved to the opened position without operation of the presser foot lifting member 76, thereby facilitating the thread exchange operation for performing subsequent embroidery patterns, and improving the operability.

Embroidery data is divided into plurality of embroidery pattern sections. The control device 100 controls the thread tension motor 32 as to move the covering member 70 to the opened position every time embroidery sewing of each embroidery pattern section is completed. Since the covering member 70 moves to the opened position automatically every time embroidery sewing of each embroidery pattern section is completed, the user's operability of the thread exchange operation can be improved.

The thread tension mechanism 20 which is linked to the thread tension motor 32, and which is provided with the thread tension regulator 30 capable of adjusting the thread tension of the needle thread 8 is provided. The control device drive controls the thread tension motor 32 so that the thread tension regulator 30 is opened, and the covering member 70 is moved to the opened position every time embroidery sewing of each embroidery pattern section is completed. In this state, the user can easily and immediately hook the upper thread 8 onto the opened thread guide groove 17, and the thread tension regulator 30. Thus, operability improvement can be achieved for the thread hooking operation to be performed in the thread exchange carried out upon completion of embroidery sewing of each embroidery pattern section.

The control device 100 moves the covering member 70 to the opened position, and opens the thread tension regulator by driving the thread tension motor 32, after the thread trimming mechanism 85 has trimmed the thread upon completion of embroidery sewing of each embroidery pattern section. Thus, since the thread hooking operation is enabled every time the needle thread 8 is trimmed and embroidery sewing is completed, the operability of the thread exchange operation can be improved.

The present invention is not limited to the embodiment described in the above description and drawings but can be transformed or expanded, for example, as follows.

The covering member 70 may be constructed to open and close any one or a plurality of the second thread guide groove 17*b*, the third thread guide groove 17*c* or the fourth thread guide groove 17*d* constituting the thread guide groove 17.

The thread tension regulator 30 may be constructed by a pair of thread supplying rollers instead of a pair of thread tension discs 30*a* and 30*b*.

In the above described embodiment, the movement of the covering member 70 from the opened position to the closed position is carried out by the drive of the thread tension motor 32. Instead, the covering member 70 may be constructed to be elastically urged to the closed position by a torsion spring, and be reverted to the closed position by the elasticity of the helical extension spring, upon lowering the presser foot lifting lever 76.

The covering member 70 may be moved to the opened position by a solenoid instead of the thread tension motor 32, and may be arranged to revert to the closed position by the elasticity of the helical extension spring.

In the above described embodiment, based on the detection of the user's needle threading lever 24 operation by the control device 100, the thread hook preparation control carried out in utility sewing renders the tension applying state of the thread tension regulator 30 and the auxiliary thread tension mechanism 22, by moving the covering member 70 to the closed position by the drive of the thread tension motor 32. However, instead, the tension applying state of the thread tension regulator 30 and the auxiliary thread tension mechanism 22 can be realized by moving the covering member 70 to the closed position by the drive of the thread tension motor 32, based on the detection of the user's lowering operation of the presser foot lifting lever 76 by the control device 100.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

We claim:

1. A sewing machine comprising:

a presser foot that presses a workpiece cloth when in lowered state;

a presser foot lifting lever operated to lift the presser foot;

a thread tension mechanism provided with a thread tension regulator capable of adjusting a thread tension of a needle thread, the thread tension regulator being opened by a lifting operation of the presser foot lifting lever;

a thread guide groove that guides the needle thread drawn from a thread supplying source at least to the thread tension mechanism, upon thread hooking;

a detector to detect the lifting operation of the presser foot lifting lever;

a covering member movable between a closed position where the covering member covers at least a part of the thread guide groove and an opened position, the covering member being moved to the closed position when the presser foot is lowered;

an actuator that moves the covering member at least from the closed position to the opened position; and a controller that controls the actuator so that the covering member is moved to the opened position when the detector detects the lifting operation.

2. The sewing machine according to claim 1, wherein the thread tension mechanism and the actuator are linked; and the controller controls the actuator so that tension applied to the needle thread by the thread tension regulator takes a predetermined value, as well as so that the thread tension regulator is opened when the detector detects the lifting operation.

3. The sewing machine according to claim 2, further comprising an auxiliary thread tension mechanism which applies auxiliary tension to the needle thread, and which is arranged between the thread tension regulator and the thread supplying source, wherein the controller controls the actuator so that the thread tension regulator and the auxiliary thread tension regulator are opened when the lifting operation of the presser foot lifting lever is detected by the detector.

4. The sewing machine according to claim 1, further comprising a preparation instructor that instructs preparation of a thread hooking operation, wherein when preparation of the thread hooking operation has been instructed by the preparation instructor and the lifting operation by the presser foot lifting lever has not been detected by the detector, the controller controls the actuator so that the covering member is moved to the opened position and the thread tension regulator is opened.

5. The sewing machine according to claim 1, wherein:

the detector is capable of also detecting the lowering operation of the presser foot lifting lever;

the actuator is capable of moving the covering member from the opened position to the closed position as well as from the closed position to the opened position; and the controller controls the actuator so that the covering member is moved to the closed position when the lifting operation of the presser foot lifting lever is detected by the detector.

6. The sewing machine according to claim 5, further comprising a needle threading mechanism that threads an eye of a needle with the needle thread, a needle threading lever that actuates the needle threading mechanism and a needle threading lever detector that detects an operation of the needle threading lever, wherein when an operation of the needle threading lever is detected by the needle threading lever detector, the controller controls the actuator so that the covering member is moved to the closed position and so that tension applied to the needle thread by the thread tension regulator takes a predetermined value.

7. A sewing machine comprising:

a stitch former that forms an embroidery stitch on a workpiece cloth retained by an embroidery frame;

a frame driver that moves the embroidery frame;

a sewing controller that controls the stitch former and the frame driver so that an embroidery pattern is sewn based on embroidery data;

a thread guide groove that guides a needle thread drawn from a thread supply to a predetermined thread path, upon thread hooking operation;

a covering member movable between a closed position where the covering member covers at least a part of the thread guide groove and an opened position, the covering member being in the closed position when in stitch forming state;

an actuator that moves the covering member at least from the closed position to the opened position;

a controller to control the actuator so that the covering member moves to the opened position when embroidery sewing by the sewing controller is completed.

8. The sewing machine according to claim 7, wherein the embroidery data is divided into a plurality of embroidery pattern sections, and the controller controls the actuator so that the covering member moves to the closed position upon every completion of embroidery sewing of each embroidery pattern section.

9. The sewing machine according to claim 8, further comprising a thread tension mechanism which has a thread tension regulator capable of thread tension adjustment, and which is linked to the actuator, wherein upon every completion of embroidery sewing of each embroidery pattern section, the controller controls the actuator so that the thread tension regulator is opened.

10. The sewing machine according to claim 8, further comprising a thread trimmer that trims the thread used in sewing performed by the stitch former, wherein the controller controls the actuator after completion of thread trimming by the thread trimmer executed upon completion of embroidery sewing of each embroidery pattern section.

11. The sewing machine according to claim 1, wherein the thread guide groove is formed so as to guide the needle thread to the thread tension regulator and to a thread take-up and a take-up spring provided downstream with respect to the thread tension regulator, and the covering member is arranged to cover a part of the thread guide groove that corresponds to a portion above the thread take-up when in closed state.

12. The sewing machine according to claim 7, wherein the thread guide groove is formed so as to guide the needle thread to a thread take-up and a take-up spring, and the covering member is arranged to cover a part of the thread guide groove that corresponds to a portion above the thread take-up when in closed state.

* * * * *